US008002214B2

(12) United States Patent
Genta et al.

(10) Patent No.: US 8,002,214 B2
(45) Date of Patent: Aug. 23, 2011

(54) ROLLED MEDIUM HOLDING DEVICE HOLDING A ROLLED MEDIUM AT BOTH ENDS AND A RECORDING APPARATUS INCLUDING THE ROLLED MEDIUM HOLDING DEVICE

(75) Inventors: Shin Genta, Suwa (JP); Takuya Yasue, Suwa (JP); Masaki Kobayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1154 days.

(21) Appl. No.: 11/692,047

(22) Filed: Mar. 27, 2007

(65) Prior Publication Data

US 2008/0011805 A1 Jan. 17, 2008

(30) Foreign Application Priority Data

Mar. 28, 2006 (JP) ..... 2006-089239
Mar. 28, 2006 (JP) ..... 2006-089240
Mar. 23, 2007 (JP) ..... 2007-077206

(51) Int. Cl.
*B65H 23/06* (2006.01)

(52) U.S. Cl. ..... 242/420.6

(58) Field of Classification Search ..... 242/416, 242/418, 420, 420.5, 420.6, 420.4
See application file for complete search history.

(56) References Cited

U.S. PATENT DOCUMENTS

| | | | | |
|---|---|---|---|---|
| 5,884,860 | A | 3/1999 | Ishikawa et al. | |
| 6,254,228 | B1 * | 7/2001 | Sago | 347/88 |
| 6,742,862 | B2 * | 6/2004 | Yamada et al. | 347/30 |
| 2007/0140772 | A1 * | 6/2007 | Barinaga | 400/636.2 |
| 2008/0019757 | A1 * | 1/2008 | Watanabe | 400/648 |
| 2009/0047052 | A1 * | 2/2009 | Koyabu | 400/611 |

FOREIGN PATENT DOCUMENTS

| | | | |
|---|---|---|---|
| JP | 09-328247 | A | 12/1997 |
| JP | 10-100499 | A | 4/1998 |
| JP | 2005-096987 | A | 4/2005 |

* cited by examiner

*Primary Examiner* — William A Rivera
(74) *Attorney, Agent, or Firm* — Workman Nydegger

(57) ABSTRACT

A rolled medium holding device includes a first gear mechanism 61 that is connected to a roll shaft holding the rolled medium and sends-out/rewinds the rolled medium, a second gear mechanism 62 that is connected to a torque limiter 64 and includes a plurality of torque transmission means, and a gear switching mechanism 63 that shifts connection between the plurality of torque transmission means and the first gear mechanism by operating the second gear mechanism for applying different back tension to the roll shaft. Accordingly, torque transferred from the torque limiter can be shifted, and whereby back tension in correspondence with a used rolled medium can be easily applied in a simple manner.

16 Claims, 19 Drawing Sheets

(B)

(A)

A–A (A)

(B)

(A)

(B)

(A)

(B)

(A)

(B)

ROLLED MEDIUM HOLDING DEVICE HOLDING A ROLLED MEDIUM AT BOTH ENDS AND A RECORDING APPARATUS INCLUDING THE ROLLED MEDIUM HOLDING DEVICE

TECHNICAL FIELD

The present invention relates to a rolled medium holding device holding a rolled medium at both ends and a recording apparatus including the rolled medium holding device, and more particularly, to a rolled medium holding device capable of easily applying appropriate back tension to a used rolled medium in a simple manner and a recording apparatus including the rolled medium holding device.

BACKGROUND ART

There are printers as one type of recording apparatuses that have a function of recording on paper wound in a roll. These printers are configured such that roll paper through which a roll shaft passes for installment is set in a roll paper holder, the roll paper is drawn out/transported by a transport roller, and a recording operation is performed by a recording head. In a center core portion of the roll shaft, a torque limiter is provided, and the torque limiter is configured to apply back tension to the roll paper (see Japanese Unexamined Patent Application Publication No. 2005-96987).

As described above, in the known printers, the back tension applied by the torque limiter is fixed. Thus, when a recording operation is performed on roll paper which is different in size or the like, the roll shaft is required to be replaced with a roll shaft that has a torque limiter in correspondence with a specification of back tension set for the type of roll paper. Accordingly, operations for replacing, storing, and managing the roll shaft become complicated.

In addition, since it is required to remove loosening of the roll paper by rewinding the roll paper, a one-way clutch for blocking torque transfer of the torque limiter is required to be provided. Therefore, there is a possibility that the structure of the roll paper holder becomes complicated and a manufacturing cost thereof becomes high.

DISCLOSURE OF INVENTION

The present invention was conceived with consideration with the above-described problems. A first object of the invention is to provide a rolled medium holding device capable of easily applying appropriate back tension to a used rolled medium in a simple manner and a recording apparatus including the rolled medium holding device.

A second object of the invention is to provide a rolled medium holding device having a simple structure and a low manufacturing cost and a recording apparatus including the rolled medium holding device.

In order to accomplish the above-described first object, a rolled medium holding device according to an embodiment of the invention includes: a first gear mechanism that is connected to a roll shaft holding the rolled medium and sends out/rewinds the rolled medium; a second gear mechanism that is connected to a torque limiter and includes a plurality of torque transfer means; and a gear switching mechanism that shifts connection between the plurality of torque transfer means and the first gear mechanism by operating the second gear mechanism to apply different back tensions to the roll shaft. Accordingly, torque transferred by the torque limiter can be changed, and whereby back tension in correspondence with a used rolled medium can be easily applied in a simple manner.

Each torque transfer means of the second gear mechanism may be provided with a hybrid gear. In such case, the transmission ratio and value of the torque transferred by the torque limiter can be easily shifted in a simple manner.

The first gear mechanism may be provided with a planetary gear. In such case, the torque limiter can easily shift between transfer/block of the torque in a simple manner.

The rolled medium holding device may be additionally provided with driving means that operates the first gear mechanism. In addition, the driving means may additionally operate the second gear mechanism. In such as case, an error in connection shift between the first gear mechanism and the torque transfer means of the second gear mechanism does not occur, and whereby precise back tension can be applied to the rolled medium assuredly.

The driving means may operate the second gear mechanism on the basis of information on the rolled medium. In addition, the driving means may operate the second gear mechanism on the basis of information on the rolled medium. In such case, appropriate back tension can be applied to the rolled medium assuredly.

In order to accomplish the above-described first object, a recording apparatus according to an embodiment of the invention, as a recording apparatus that performs recording on a rolled recording medium while transporting the recording medium, is provided with the above-described rolled medium holding device. Accordingly, a recording apparatus exhibiting the same advantages as described above can be provided.

The driving means may temporarily apply back tension to the rolled medium by rewinding the rolled medium right before start of the recording operation. In such as case, since loosening of the rolled medium right after being fed can be removed, precision of a recording image quality can be improved by suppressing occurrences of wrinkles in transport of the rolled medium.

In order to achieve the second object, a rolled medium holding device according to an embodiment of the invention includes a back tension mechanism that applies back tension by forward rotation of a roll shaft holding a rolled medium and releases the applied back tension by backward rotation of the roll shaft, wherein the back tension mechanism is provided with a spring clutch that is inserted into the roll shaft and generates slipping torque/tightening torque on the roll shaft by expansion/contraction thereof in a diameter direction and torque is transferred in a drawing-out direction of the rolled medium in accordance with the slipping torque of the spring clutch and transfer of the torque in a rewinding direction is blocked by the tightening torque. Accordingly, a one-way clutch that is generally needed is not required, and thus, the rolled medium holding device can have a simple structure and a low manufacturing cost.

The above-described rolled medium holding device may be provided with the first gear mechanism that is connected to the roll shaft, a second gear mechanism that is connected to the spring clutch, and a gear shifting mechanism that shifts a gear connected to the first gear mechanism and the second gear mechanism, wherein the back tension is applied by connecting/disconnecting the first gear mechanism and the second gear mechanism by the forward/backward rotation of the roll shaft. In such case, since the torque transferred by the spring clutch can be changed, back tension in correspondence with the rolled medium can be easily applied in a simple manner.

One end of the spring clutch may be pinched by the second gear mechanism and the other end of the spring clutch may be pinched by a bearing that is fitted to a shaft of the second gear mechanism. In such case, slipping torque is applied to the second gear mechanism and the bearing when the spring clutch expands in a diameter direction, and tightening torque is applied to the second gear mechanism and the bearing when the spring clutch contracts in a diameter direction.

The second gear mechanism may be provided with a hybrid gear. In such case, the transmission ratio and value of the torque transferred by the torque limiter can be easily shifted in a simple manner.

The first gear mechanism may be provided with a planetary gear. In such case, the torque limiter can easily shift between transfer/block of the torque in a simple manner.

In order to accomplish the above-described second object, a recording apparatus according to an embodiment of the invention, as a recording apparatus that records on a rolled recording medium while transporting the recording medium, includes the above-described rolled medium holding device. Accordingly, a recording apparatus exhibiting the same advantages as described above can be provided.

BEST MODE FOR CARRYING OUT THE INVENTION

Hereinafter, embodiments of the present invention will be described with reference to the accompanying drawings. The embodiments to be described below are not for limiting the scope of the invention defined by the claims, and the whole combination of features described in the embodiments should not be construed as being essential to the solving means of the invention.

Figure 1:
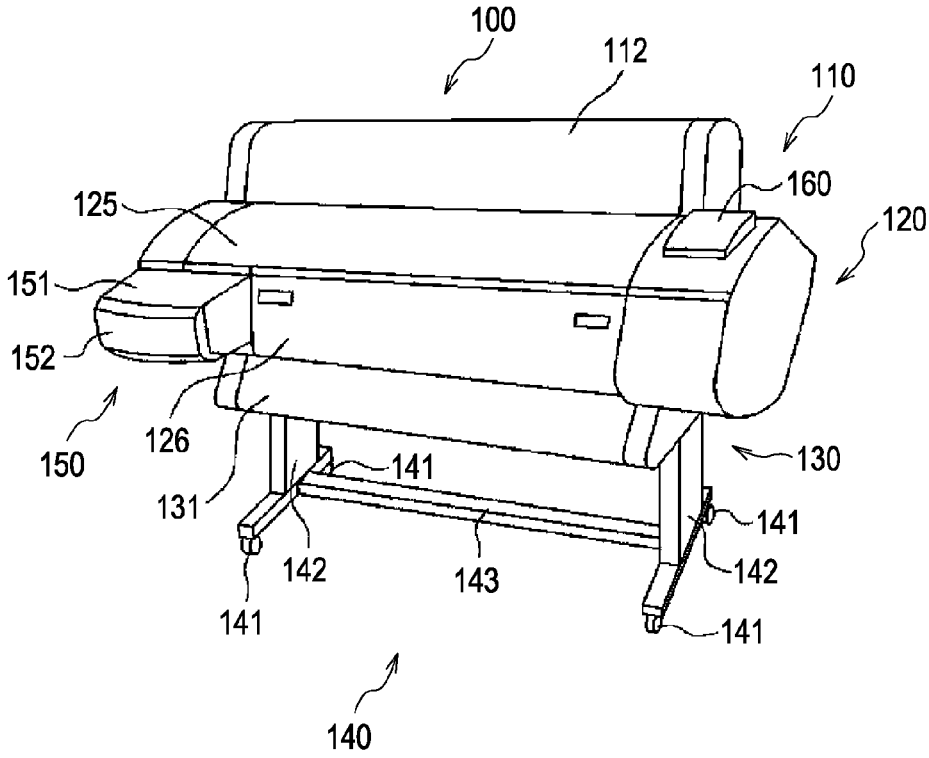
FIG. 1 is a perspective view of an ink-jet printer as an example of a recording apparatus, showing its exemplary construction according to an embodiment of the invention.
Figure 2:
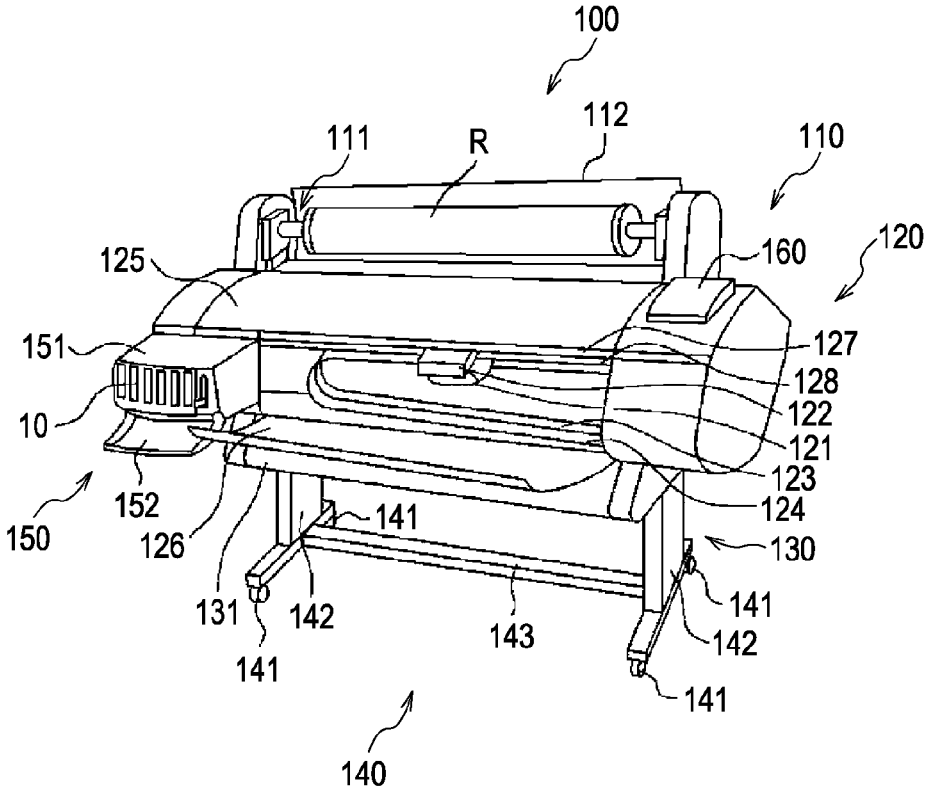
FIG. 2 is a perspective view of the ink-jet printer, showing the internal construction of its main portion of the printer shown in FIG. 1.
Figure 3:
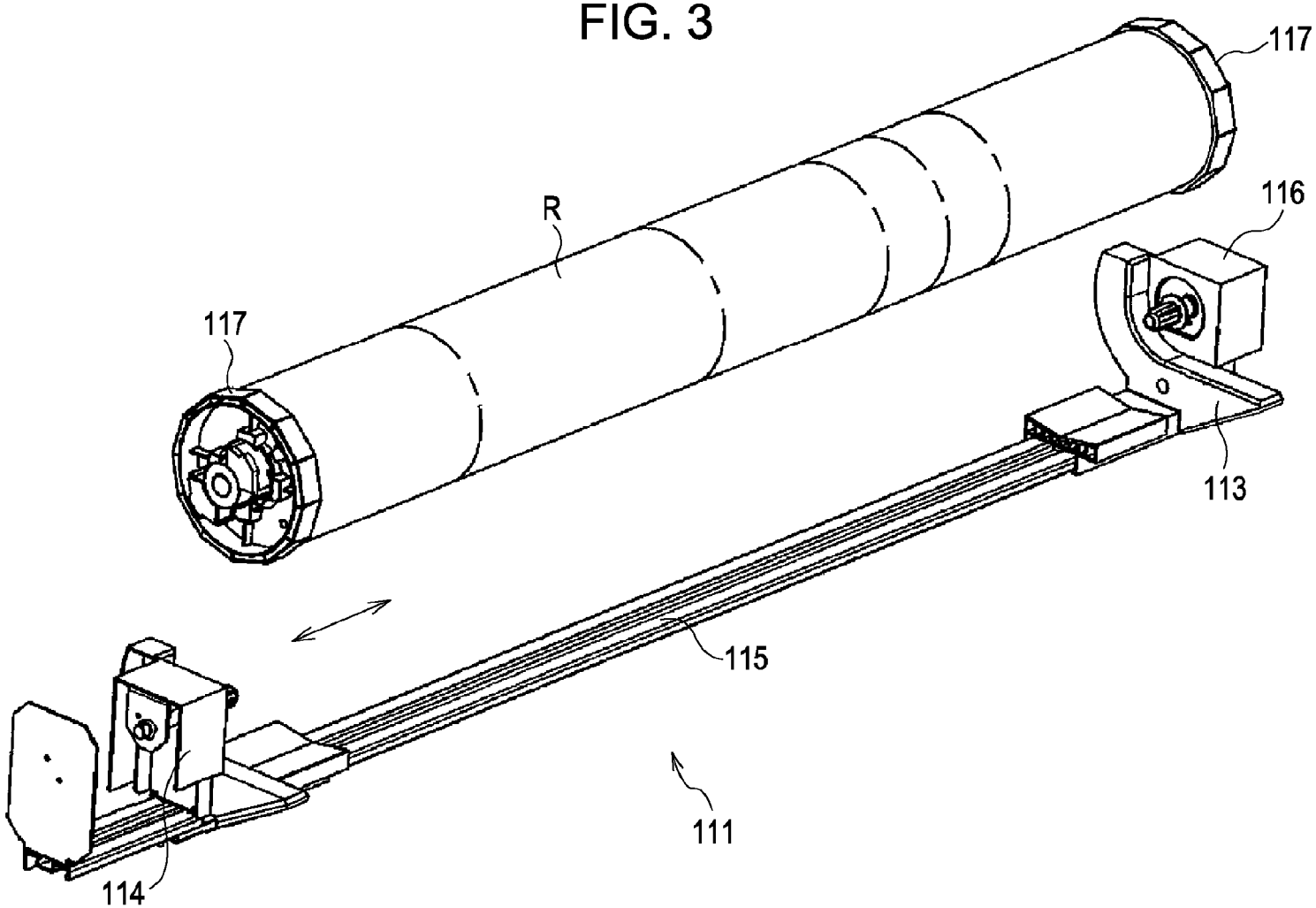
FIG. 3 is a perspective view showing a rolled medium holding device according to an embodiment of the invention.

In the drawings, FIG. 1 is a perspective view of an ink-jet printer as an example of a recording apparatus, showing its exemplary construction according to an embodiment of the invention; FIG. 2 is a perspective view of the ink-jet printer, showing the internal construction of its main portion of the printer shown in FIG. 1; and FIG. 3 is a perspective view of a rolled medium holding device according to an embodiment of the invention. The ink-jet printer 100 is a large-sized printer capable of recording data on a relatively large-sized roll paper (rolled medium), for example, a paper of A1 size or B1 size in the JIS standard.

As shown in FIG. 1, in the ink-jet printer 100, a feeding unit 110 to which the roll paper is set, a recording/transporting unit 120, a paper discharging unit 130, and a leg portion 140 are arranged in this order from the upper portion thereof. Specifically, the roll paper supplied from the feeding unit 110 disposed in the uppermost portion is transported obliquely downward between the recording/transporting unit 120 and the discharging unit 130 which are obliquely disposed relative to each other in the lower portion of the feeding unit 110. The roll paper is then discharged to a paper discharging tray (not shown) disposed in the leg portion 140 that is disposed in the lowermost portion. The recording/transporting unit 120 and the paper discharging unit 130 are integrated as a main body, and the paper feeding unit 110 and the leg portion 140 are configured to be separable from the main body.

As shown in FIG. 1, the paper feeding unit 110 is disposed to protrude from the upper rear portion of the main body 120 and 130. Inside the paper feeding unit 110, as shown in FIG. 2, there is provided a roll paper holder (rolled medium holding device) 111 capable of setting one roll paper R thereto. Further, as shown in FIGS. 1 and 2, a flip-up type roll paper cover 112 that can be opened and closed is fitted to the front of the paper feeding unit 110.

As shown in FIG. 3, the roll paper holder 111 is provided with a fixed flange receiver 113, a movable flange receiver 114, a guide rail 115, and a tension adjustment mechanism (back tension mechanism) 116. The fixed flange receiver 113 is fixed to one of side walls of the paper feeding unit 110 so as to axially support the flange 117 fitted to one end of the roll paper R in a rotatable manner. The movable flange receiver 114 is movably disposed in the other side wall of the paper feeding unit 110 so as to axially support the flange 117 fitted to the other end of the roll paper R in a rotatable manner.

A guide rail 115 is disposed between the fixed flange receiver 113 and the movable flange receiver 114 so as to guide the sliding of the movable flange receiver 114. The flanges 117 at both sides of the roll paper R are fitted to and supported by the fixed flange receiver 113 and the movable flange receiver 114. The movable flange receiver 114 can slide along the guide rail 115, and it is therefore possible to support different-sized roll papers R, as indicated by the dashed-dotted lines in the drawing. The tension adjustment mechanism 116 will be described later in detail.

As shown in FIGS. 1 and 2, the entire portion of the roll paper cover 112 is pivotably supported and is configured to be opened or closed by the user raising or pressing down the lower portion of the roll paper cover 112. Accordingly, the user can open or close the roll paper cover 112 and it is therefore possible to reduce time for replacing the roll paper R. Since the roll paper cover 112 is fitted so as to cover the roll paper holder 111, it is possible to prevent contamination of the roll paper R held in the roll paper holder 111 and to ensure the user's security.

As shown in FIG. 2, the recording/transporting unit 120 is provided with a carriage 122 having a recording head 121 mounted thereon, a flexible flat cable (hereinafter referred to as FFC) 123 for electrically connecting the recording head 121 to a control unit (not shown) for causing a recording operation to be performed, and an ink tube 124 for connecting the recording head 121 to an ink cartridge 10 filled with ink. The recording/transporting unit 120 is further provided with a paper feeding roller (not shown) and a driven roller (not shown) which are opposed to move toward and away from each other, a platen (not shown) disposed opposite to the recording head 121 mounted on the carriage 122, and so forth. As shown in FIGS. 1 and 2, an upper cover 125 and a front cover 126 are fitted to the top and front faces of the recording/transporting unit 120 so as to cover the recording head 121, the carriage 122, and the like.

The recording head 121 is provided with a black ink recording head that ejects black ink and a plurality of color ink recording heads that eject each color of light yellow, yellow, light cyan, cyan, light magenta, and magenta. Further, the recording head 121 has a pressure generating chamber and nozzle openings communicating with the pressure generating chamber. The pressure generating chamber storing the ink therein is pressurized at a predetermined pressure, whereby size-controlled ink droplets are ejected from the nozzle openings to the roll paper. As shown in FIG. 2, the carriage 122 is suspended via a roller from a rail 127 provided in the main scanning direction and is coupled to a carriage belt 128. When the carriage belt 128 is operated by a carriage driving device (not shown), the carriage 122 cooperates with the movement of the carriage belt 128 and reciprocates while being guided by the rail 127.

As shown in FIG. 2, one end of the FFC 123 is connected to a connector of the control unit and the other end is connected to a connector of the recording head 121, so that recording signals are sent from the control unit to the recording head 121. The ink tube 124 is provided for each ink of different colors. One end of each ink tube 124 is connected to the ink cartridge 10 for corresponding color via an ink pressurizing/supplying device (not shown), and the other end of each ink tube 124 is connected to the recording head 121 for corresponding color. As shown in FIGS. 1 and 2, the lower portion of the front cover 126 is pivotably supported and is configured to be opened or closed by the user pressing down or raising the upper portion of the front cover 126.

The paper feeding roller is formed as one lengthy roller, and both ends are axially supported by a side frame via a bearing. The paper feeding roller is driven with the driving force transmitted from a paper feeding motor via a pulley and a belt so as to rotate in a positive or negative direction. The driven roller is formed as a plurality of short rollers, and is axially supported by a plurality of driven-roller support members which are arranged above the paper feeding roller in parallel to the axial direction. The platen is formed in a rectangular flat plate shape slightly longer than the maximum recordable paper width, and is disposed close to the downstream side of the transportation path of the paper feeding roller.

As shown in FIGS. 1 and 2, the paper discharging unit 130 is provided with a paper discharging guide 131 forming a part of the path through which the roll paper is transported in the sub-scanning direction and a paper discharging roller (not shown) for transporting the roll paper in the sub-scanning direction. As shown in FIGS. 1 and 2, the leg portion 140 is provided with two support pillars 142 having moving casters 141 and a reinforcing bar 143 stretched between the support pillars 142. The paper feeding unit 110 and the body 120 and 130 are placed on the support pillars 142 and fixed with screws.

As shown in FIGS. 1 and 2, a holder body 151 for receiving and holding the ink cartridge 10 for each color and an ink cartridge holder 150 having a cover 152 for covering the front of the holder body 151 are disposed on the left side of the body 120 and 130 as seen from the front side thereof. As shown in FIGS. 1 and 2, an operation panel 160 for allowing the user to perform a recording control and the like is disposed in the upper portion on the right side of the body 120 and 130 as seen from the front side thereof. A liquid crystal screen and various buttons, which are electrically connected to a control unit (not shown), are disposed on the operation panel 160 and the user is allowed to push the buttons while looking at the screen for confirmation.

Figure 4:
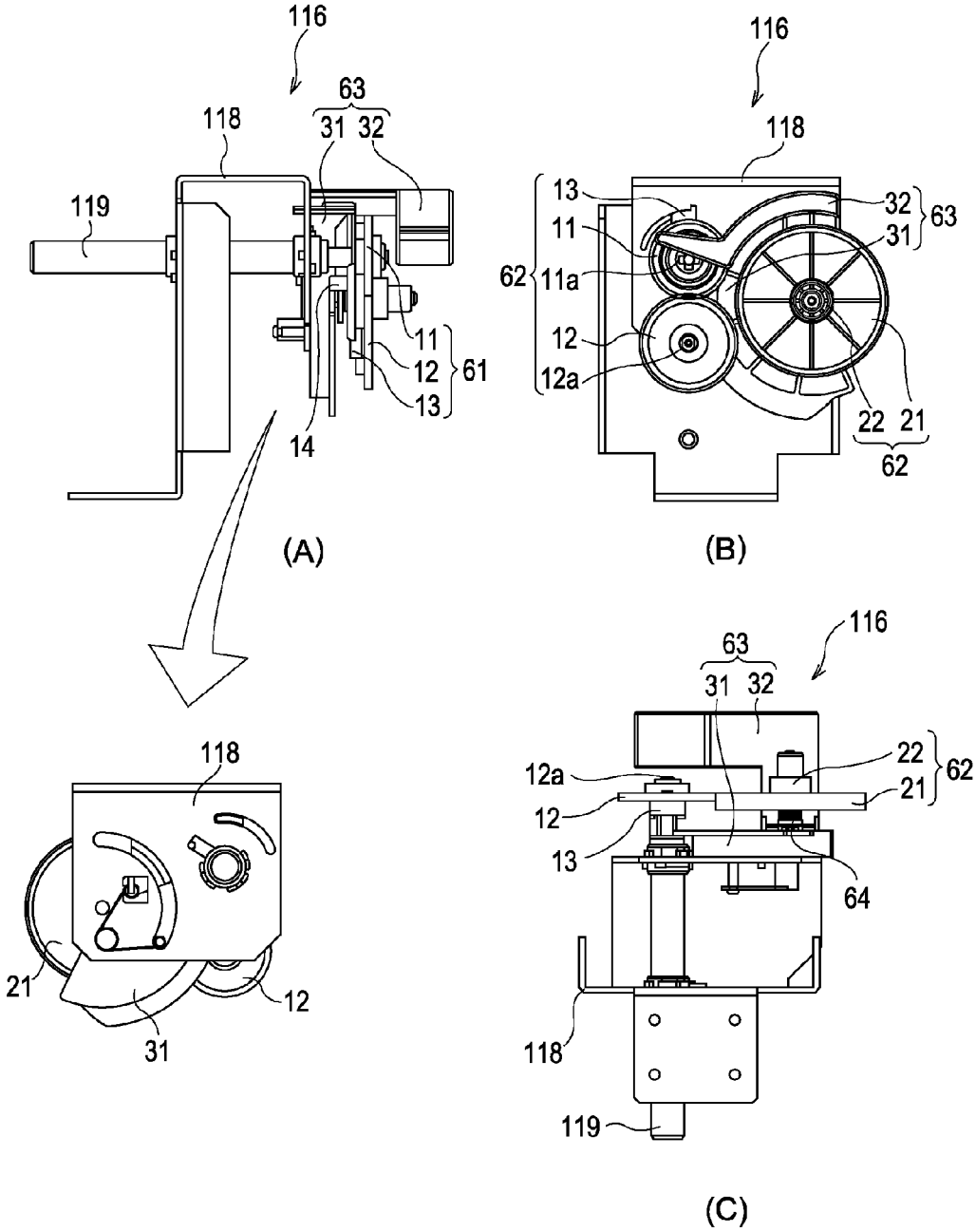
FIG. 4 is a tension adjustment mechanism of the rolled medium holding device shown in FIG. 3 according to a first embodiment of the invention.

FIGS. 4(A), 4(B), and 4(C) are diagrams showing a tension adjusting mechanism 116 according to a first embodiment as viewed from three sides. This tension adjusting mechanism 116 includes a planetary gear mechanism (first gear mechanism) 61, a hybrid gear mechanism (second gear mechanism) 62, a gear shifting mechanism 63, and a torque limiter 64 and is disposed in a frame 118 of a fixing flange receiver 113.

The planetary gear mechanism 61 includes a sun gear 11 that is fitted to a shaft 11*a* connected to a roll shaft 119 fitted to the flange 117 shown in FIG. 3, a planetary gear 12 that is interlocked with the sun gear 11, and a link 13 that connects the shaft 11*a* of the sun gear 11 and a shaft 12*a* of the planetary gear 12. The hybrid gear mechanism 62 includes first and second torque transmission gears (a torque transfer means and a hybrid gear) 21 and 22 that are interlocked with the planetary gear 12 independently, are disposed coaxially with each other, and transfer the first and second torque different with each other. The gear shifting mechanism 63 is disposed coaxially with the first and second torque transmission gears 21 and 22 and includes a cam portion 31 and a lever portion 32 formed integrally with the cam portion 31. The torque limiter 64 is disposed coaxially with the first and second torque transmission gears 21 and 22.

Figure 5:
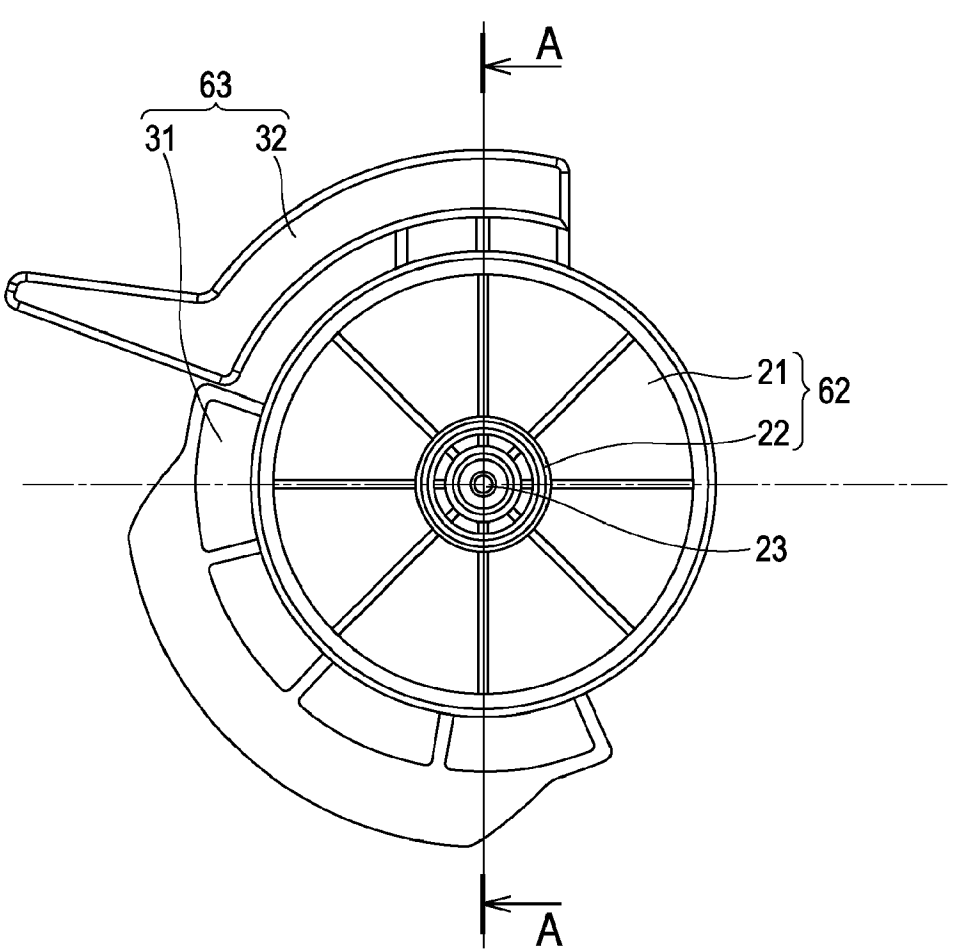
FIG. 5 is a side view and a plan view showing in detail a hybrid gear mechanism, a gear shifting mechanism, and a torque limiter of the tension adjustment mechanism shown in FIG. 4.
Figure 5:
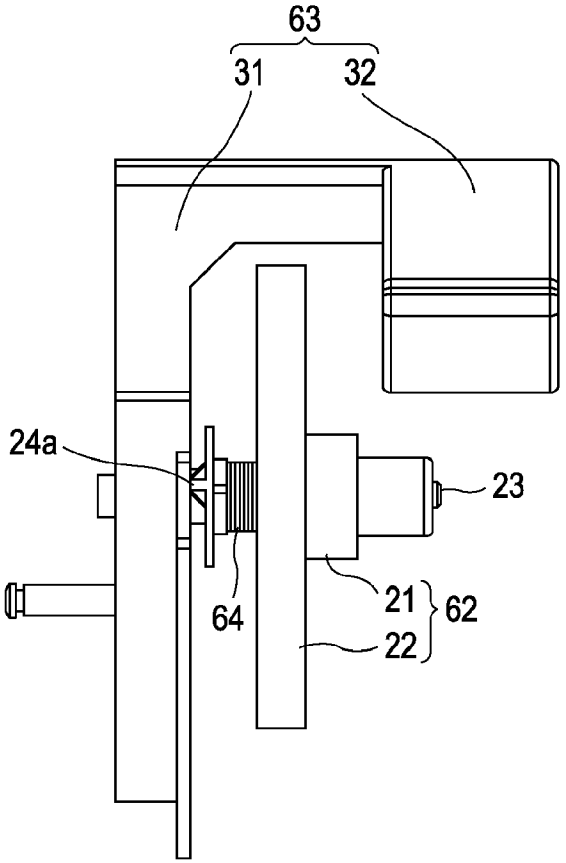
Figure 6:
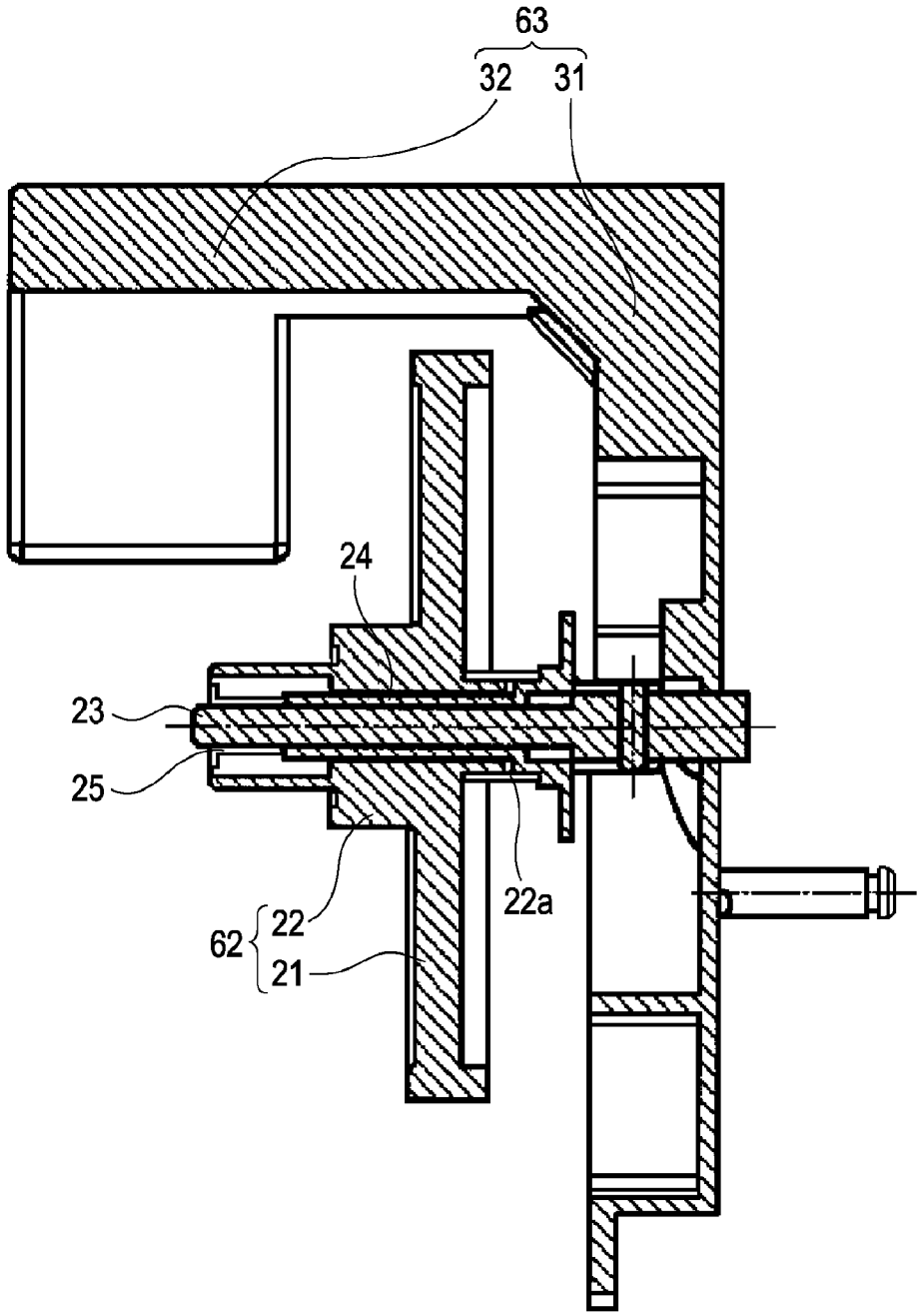
FIG. 6 is a sectional view taken along the line A-A shown in FIG. 5.

FIGS. 5(A), 5(B) and 6 are a side view, a plan view, and a sectional view taken along the line A-A showing the hybrid gear mechanism 62, the gear shifting mechanism 63, and the torque limiter 64 in detail. The first torque transmission gear 21 has a diameter larger than that of the second torque transmission gear 22 and is formed integrally with the second torque transmission gear 22. The first and second torque transmission gears 21 and 22 are inserted into a shaft (roll shaft) 23, that is supported by a frame 118 to be parallel to a roll shaft 119, rotatably through a bearing 24 and movably in the shaft direction.

The cam portion 31 is formed in the shape of a fan and is inserted into the shaft 23 in a rotatable manner. The lever portion 32 is formed to protrude from the cam portion 31 in the shape of an approximate letter "L" so as to be a handle for rotating the cam portion 31. The torque limiter (spring clutch) 64 is a helical torsion spring and is inserted into a portion over a boss 22*a* of the bearing 24 and the torque transmission gears 21 and 22. One end of the torque limiter 64 is pinched by the bearing 24, and the other end of the torque limiter is pinched by the torque transmission gears 21 and 22. Accordingly, the torque limiter 64 applies slipping torque to the boss 22*a* of the bearing 24 and the torque transmission gears 21 and 22 in a direction expanding in a diameter direction and applies tightening torque to the boss 22*a* of the bearing 24 and the torque transmission gears 21 and 22 in a direction contracting in a diameter direction. Thus, when the direction of rotation transferred through the torque transmission gears 21 and 22 is a drawing-out direction of the roll paper, torque is configured to be transferred depending on the slipping torque of the torque limiter 64, and when the direction of rotation transferred through the torque transmission gears 21 and 22 is a rewinding direction of the roll paper, the torque transfer is configured to be blocked depending on the tightening torque of the torque limiter 64.

Accordingly, since the torque limiter 64 can have an additional function of a one-way clutch along with the function of a torque limiter, the structure for applying back tension to the roll paper can be simplified and the cost can be reduced. The torque to be transferred can be adjusted by a wire diameter and the number of effective turns of the torque limiter 64, a diameter of the boss 22*a* of the bearing 24 and the torque transmission gears 21 and 22, and a tightening margin between an inner diameter of the torque limiter 64 and the diameter of the boss 22*a* of the bearing 24 and the torque transmission gears 21 and 22. Between a front end of the bearing 24 and a front end of the shaft 23, a helical compressive spring 25 is interposed. The torque transmission gears 21 and 22, the torque limiter 64, and the bearing 24 are pressed in a shaft direction of the cam portion 31 side.

Figure 7:
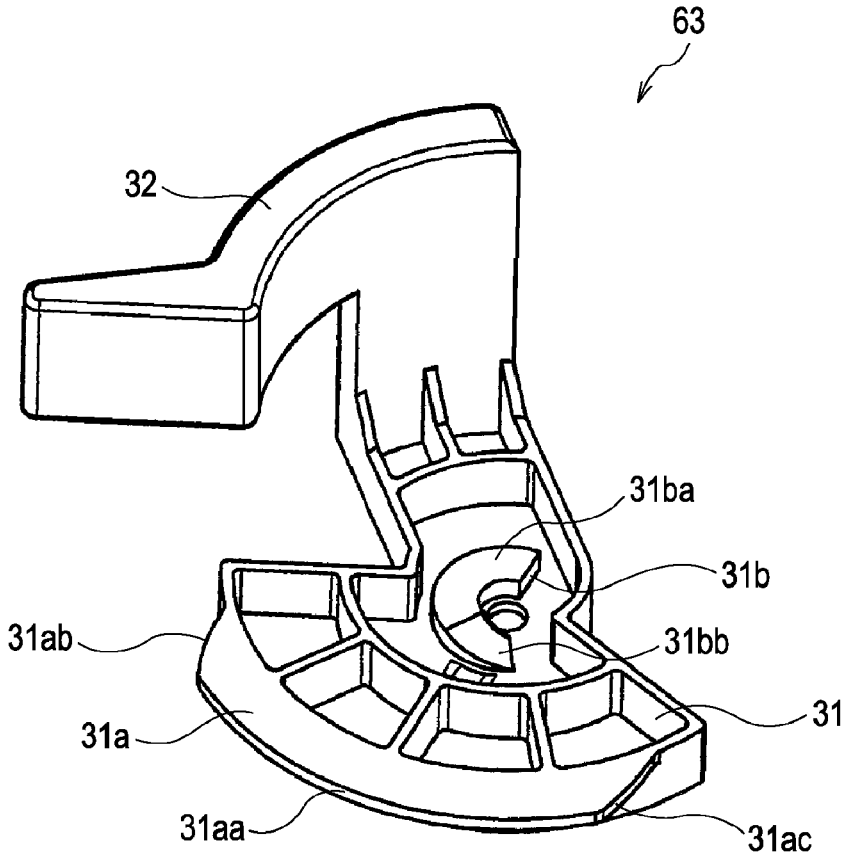
FIG. 7 is a perspective view and a plan view showing the gear shifting mechanism shown in FIG. 5 in more details.
Figure 7:
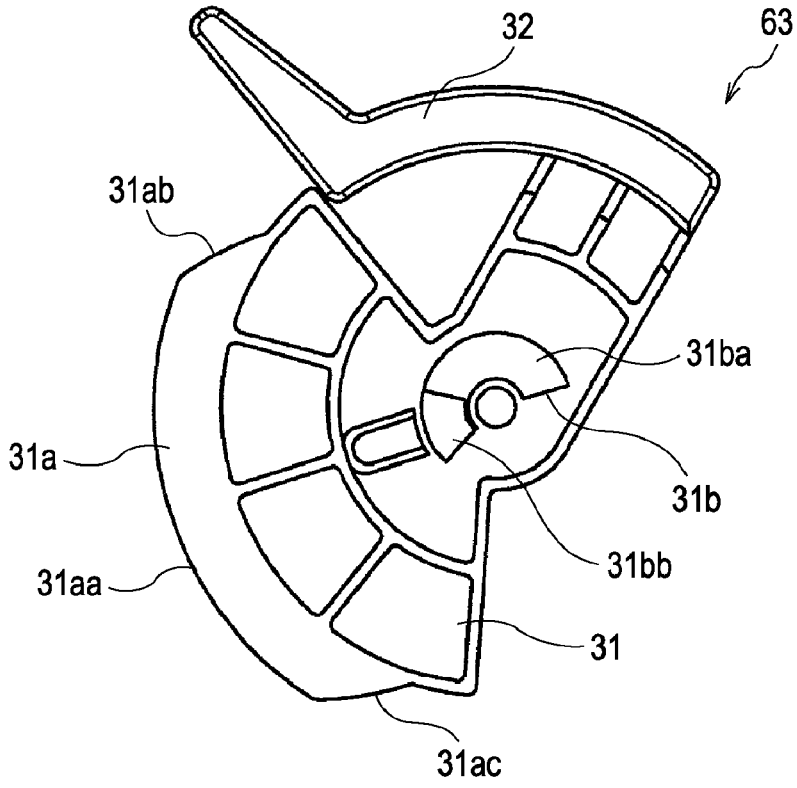

FIGS. 7(A) and 7(B) are a perspective view and a plan view showing the gear shifting mechanism 63 in more details. In an outer circumference portion of the cam portion 31, a first cam 31*a* is formed integrally, and in an inner circumference portion of the cam portion 31, a second cam 31*b* is formed integrally. The first cam 31*a* includes an arc portion 31*aa* and tilt portions 31*ab* and 31*ac* formed on both sides of the arc portion 31*aa*. The first cam 31*a* has a function of releasing interlocking between the planetary gear 12 and the first and second torque transmission gears 21 and 22 by making contact with the boss 14 shown in FIG. 4(A) that is provided in the link 13. The second cam 31*b* includes an arc face 31*ba* and a tilt face 31*bb* formed on one side of the arc face 31*ba*. The second cam 31*b* continuously contacts a cam pin 24*a* shown in FIG. 5(A) that extends from the bearing 24 in the shaft direction for pressing and has a function of moving the first and second torque transmission gears 21 and 22, the torque limiter 64, and the bearing 24 in the shaft direction. Under the above-described configuration, operations will now be described with reference to drawings.

Figure 8:
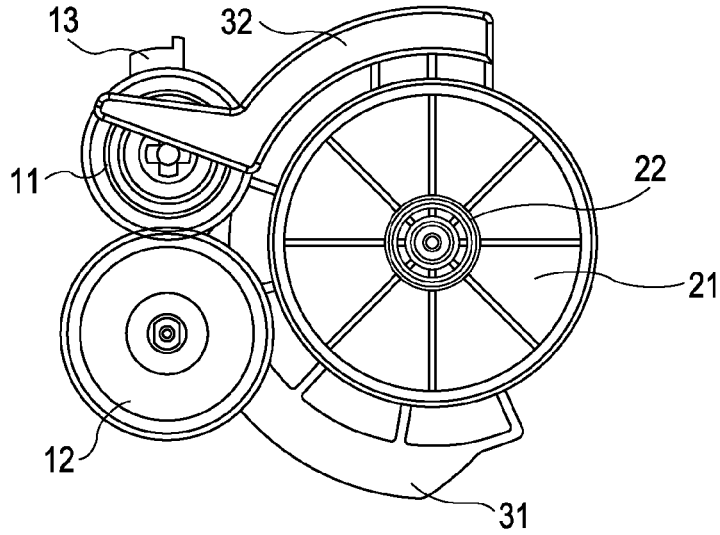
FIG. 8 is a first side view and a bottom view describing an operation of the tension adjustment mechanism shown in FIG. 4.
Figure 8:
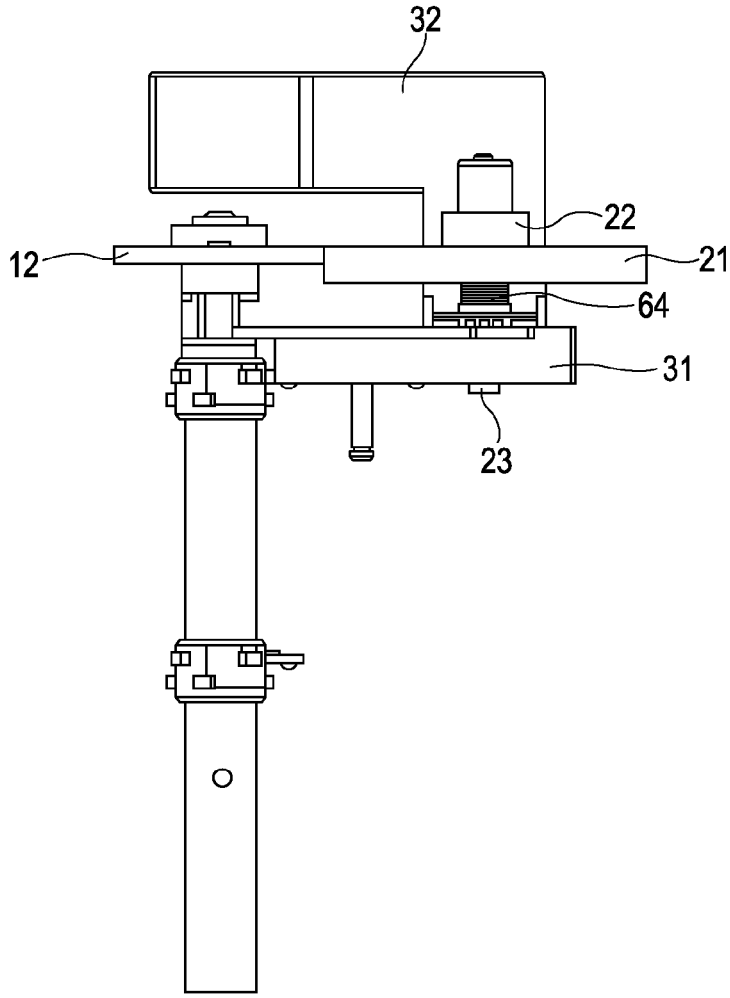
Figure 9:
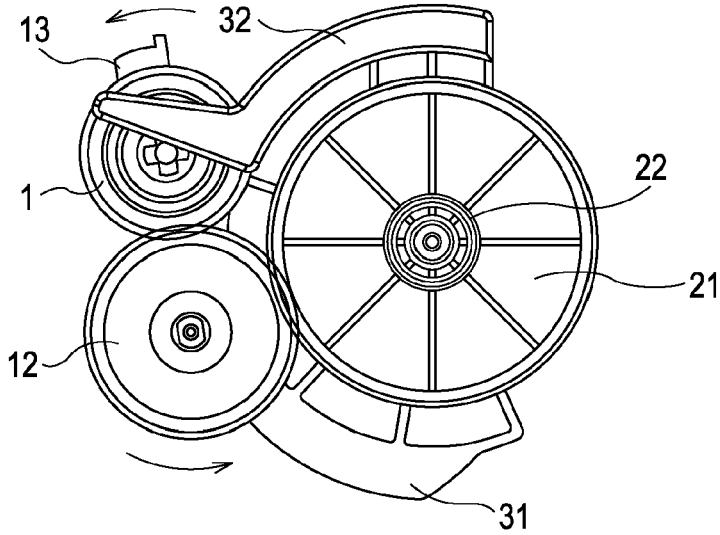
FIG. 9 is a second side view and a bottom view describing an operation of the tension adjustment mechanism shown in FIG. 4.
Figure 9:
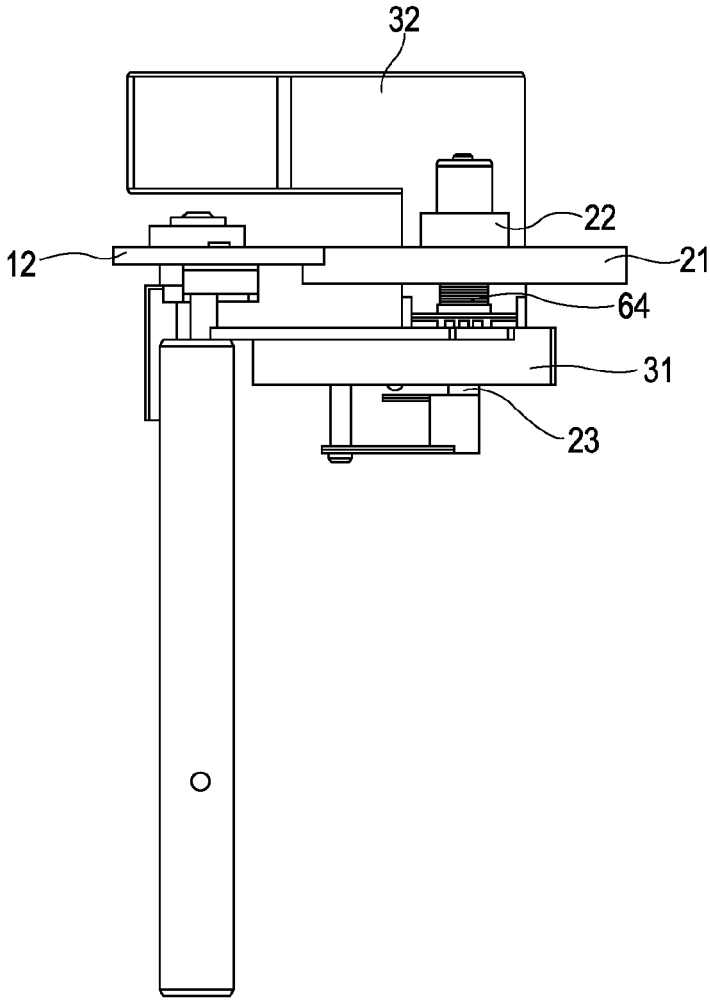
Figure 10:
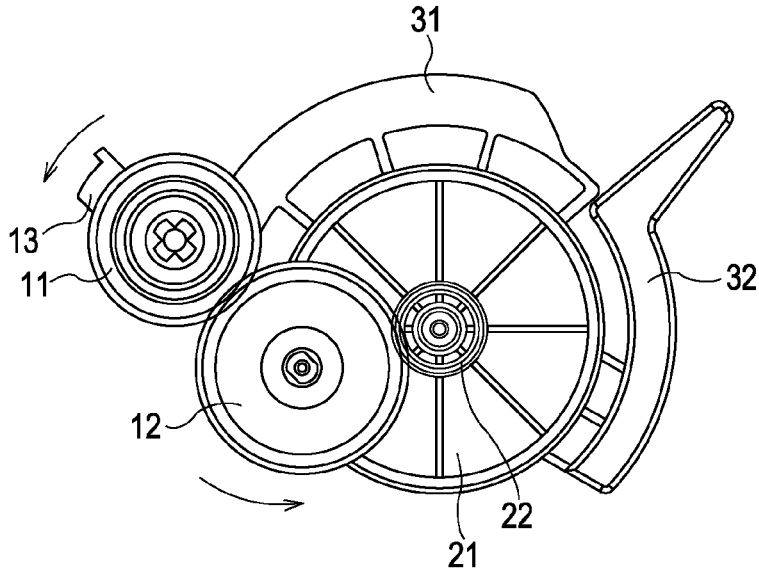
FIG. 10 is a third side view and a bottom view describing an operation of the tension adjustment mechanism shown in FIG. 4.
Figure 10:
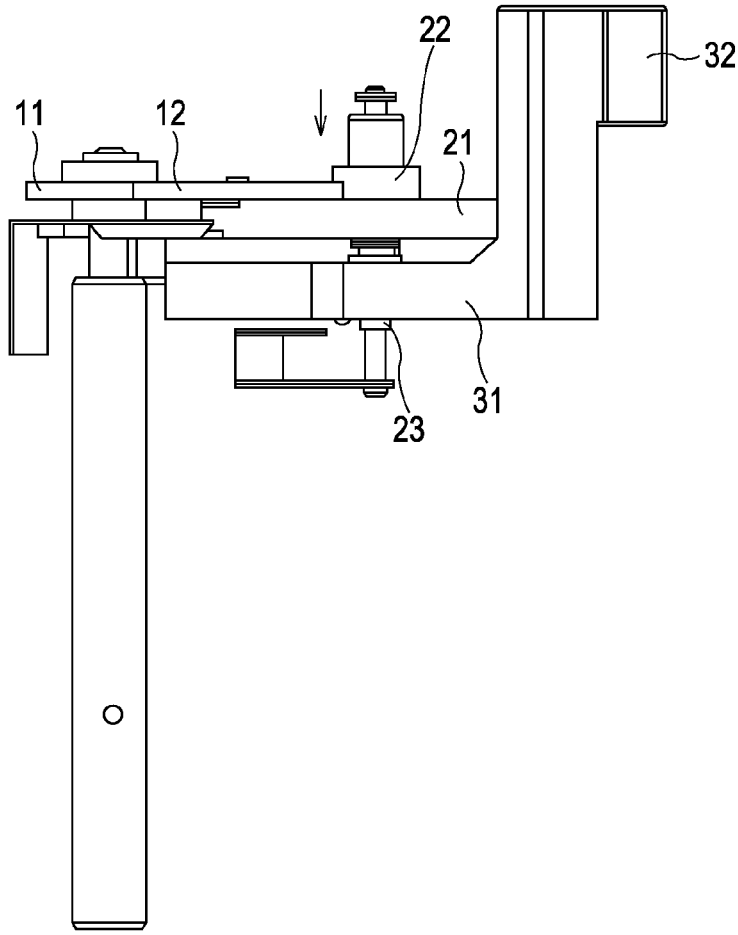

FIGS. 8(A) and 8(B) to 10(A) and 10(B) are a side view and a bottom view for describing an operation of the tension adjusting mechanism 116. FIG. 8 shows a status at a time when transport of the roll paper is waited or the roll paper is rewound. FIG. 9 shows a status at a time when the first back tension is applied by the first torque transmission gear 21 in transport of the roll paper or when it is shifted to the first torque transmission gear 21 in the start of recording on the roll paper. FIG. 10 shows a status at a time when the second back tension is applied by the second torque gear 22 in transport of the roll paper or when connection is shifted to the second torque transmission gear 22 in the start of recording on the roll paper.

When the transport of the roll paper is waited for, as a shown in FIG. 8(A), the planetary gear 12 is separated from the first and second torque transmission gears 21 and 22 and is not locked therewith. The lever portion 32 is disposed on the left side shown in FIG. 8(A), and the cam pin 24*a* of the bearing 24 makes contact with the arc face 31*ba* of the cam portion 31. Accordingly, the first and second torque transmission gears 21 and 22, as shown in FIG. 8(B), move in a direction away from the front end side of the shaft 23, that is, the lever portion 32. At this moment, the planetary gear 12 is made to be able to be interlocked with the first torque transmission gear 21.

When the first back tension is applied by the first torque transmission gear 21 in transport of the roll paper, transport of the roll paper is started while the status shown in FIG. 8 is maintained. Here, a spring not shown in the figure is disposed between the satellite gear 12 and the link 13 such that autorotation torque becomes larger than revolution torque. Thus, when the transport of the roll paper is started, the link 13 turns in a right direction shown in FIG. 9(A), and accordingly, the planetary gear 12 is interlocked with the first torque transmission gear 21. The torque transferred by the torque limiter 64 is transferred from the first torque transmission gear 21 to the sun gear 11 through the planetary gear 12. Therefore, the first back tension that is determined by number of saws of the first torque transmission gear 21, the planetary gear 12, and the sun gear 11 is applied to the roll paper.

When it is to be shifted to the second back tension depending on the second torque transmission gear 22 in the transport of the roll paper, the lever portion 32 is rotated to a position on the right side shown in FIG. 10(A) with the status shown in FIG. 9 maintained. At this moment, since the boss 14 provided in the link 13 passes through the tilt portion 31*ab* of the first cam 31*a* to reach the arc portion 31*aa*, the planetary gear 12 becomes away from the first torque transmission gear 21, and whereby the interlocking is released. Accordingly, when passing through the arc portion 31*aa* of the first cam 31*a*, the boss 14 provided in the link 13 does not follow the tilt portion 31*ac* and becomes in a status of being separated from the tilt portion 31*ac*.

The cam pin 24*a* of the bearing 24 moves from the arc face 31*ba* of the second cam 31*b*, passes through the tilt portion 31*bb*, and reaches a side of the cam portion 31 on its inner circumference. Accordingly, the first and second torque transmission gears 21 and 22, as shown in FIG. 10(B), move in a direction toward the rear end of the shaft 23, that is, the lever portion 32. At this moment, the planetary gear 12 is made to be able to be interlocked with the second torque transmission gear 22. Since the roll paper is in a transported status, the link 13 turns in a right direction shown in FIG. 10(A), and the planetary gear 12 is interlocked with the second torque transmission gear 22.

The torque transferred by the torque limiter 64 is transferred from the second torque transmission gear 22 to the sun gear 11 through the planetary gear 12. Accordingly, the second back tension determined by the numbers of saws of the second torque transmission gear 22, the planetary gear 12, and the sun gear 11, that is, the second back tension smaller than the first back tension applied at a time when FIG. 9 is represented is applied to the roll paper. When the second back tension depending on the second torque transmission gear 22 is shifted to the first back tension depending on the first torque gear 21 in transporting the roll paper, an operation that is reverse of the above-described operation is performed.

When the roll paper is rewound, since the automation torque is larger than the revolution torque in the planetary gear 12, as shown in FIG. 8(A), the planetary gear 12 is separated from the first and second torque transmission gears 21 and 22 without being interlocked therewith. Accordingly, since the torque from the torque limiter 64 is blocked, the roll paper can be rewound with a low load. In the embodiment described above, although the hybrid gear mechanism 62 is configured to have two successive gears of the first and second torque transmission gears 21 and 22, the present invention is not limited thereto, and the hybrid gear mechanism 62 may have arbitrary numbers of successive torque transmission gears.

As described above, in the roll paper holder 111 according to the first embodiment, the torque transferred from the torque limiter 64 can be changed by the gear shifting mechanism 63, and accordingly, back tension in correspondence with a used roll paper can be applied easily in a simple manner. In addition, since the hybrid gear mechanism 62 includes the first and second torque transmission gears 21 and 22, a transmission ratio and a torque value of the torque transmitted by the torque limiter can be easily shifted in a simple manner. In addition, since the planetary gear mechanism 61 includes the planetary gear 12 interlocked with the sun gear 11, transmission/block of torque using the torque limiter 64 can be easily shifted thererbetween in a simple manner. The structure of the torque limiter 64 is not limited to a helical torsion spring, and the torque limiter 64 having a general structure exhibits the same advantages.

Figure 11:
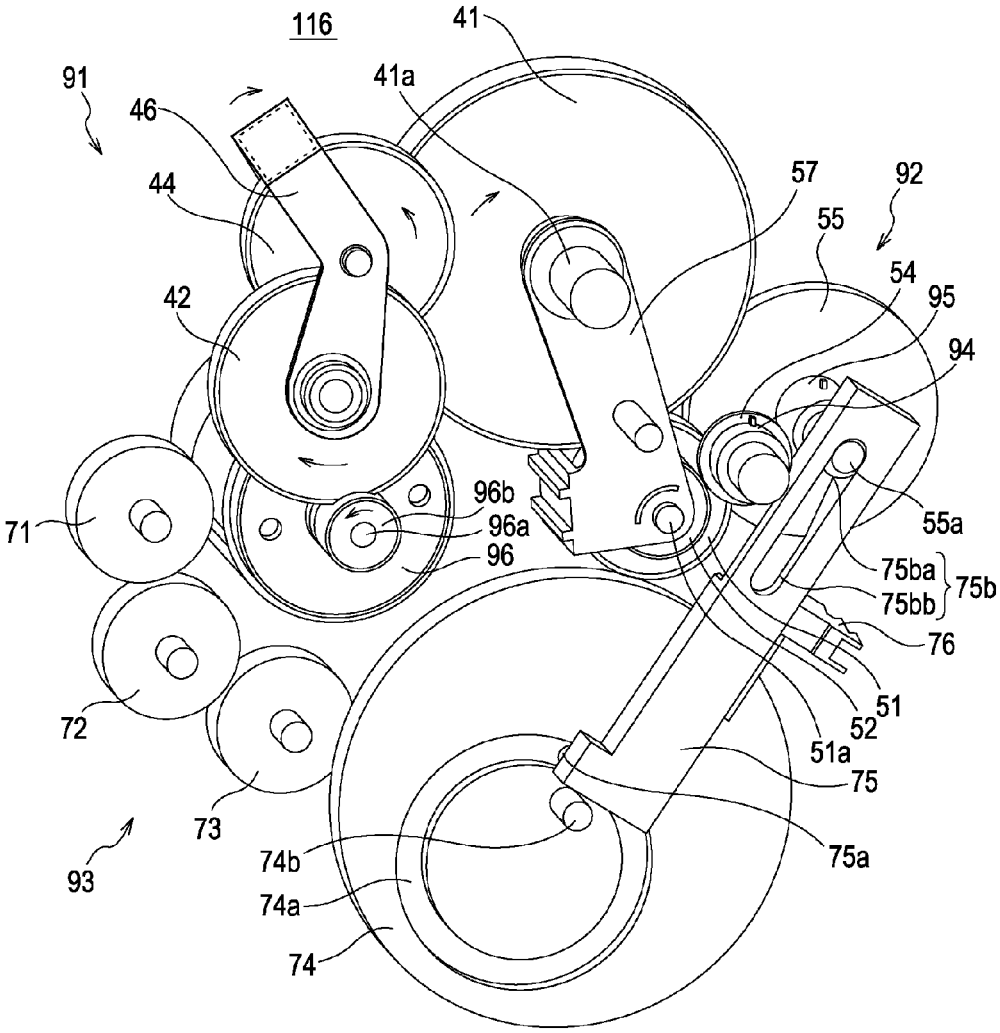
FIG. 11 is a perspective view of the tension adjustment mechanism of the rolled medium holding device shown in FIG. 3 according to a second embodiment, viewed from a front side.
Figure 12:
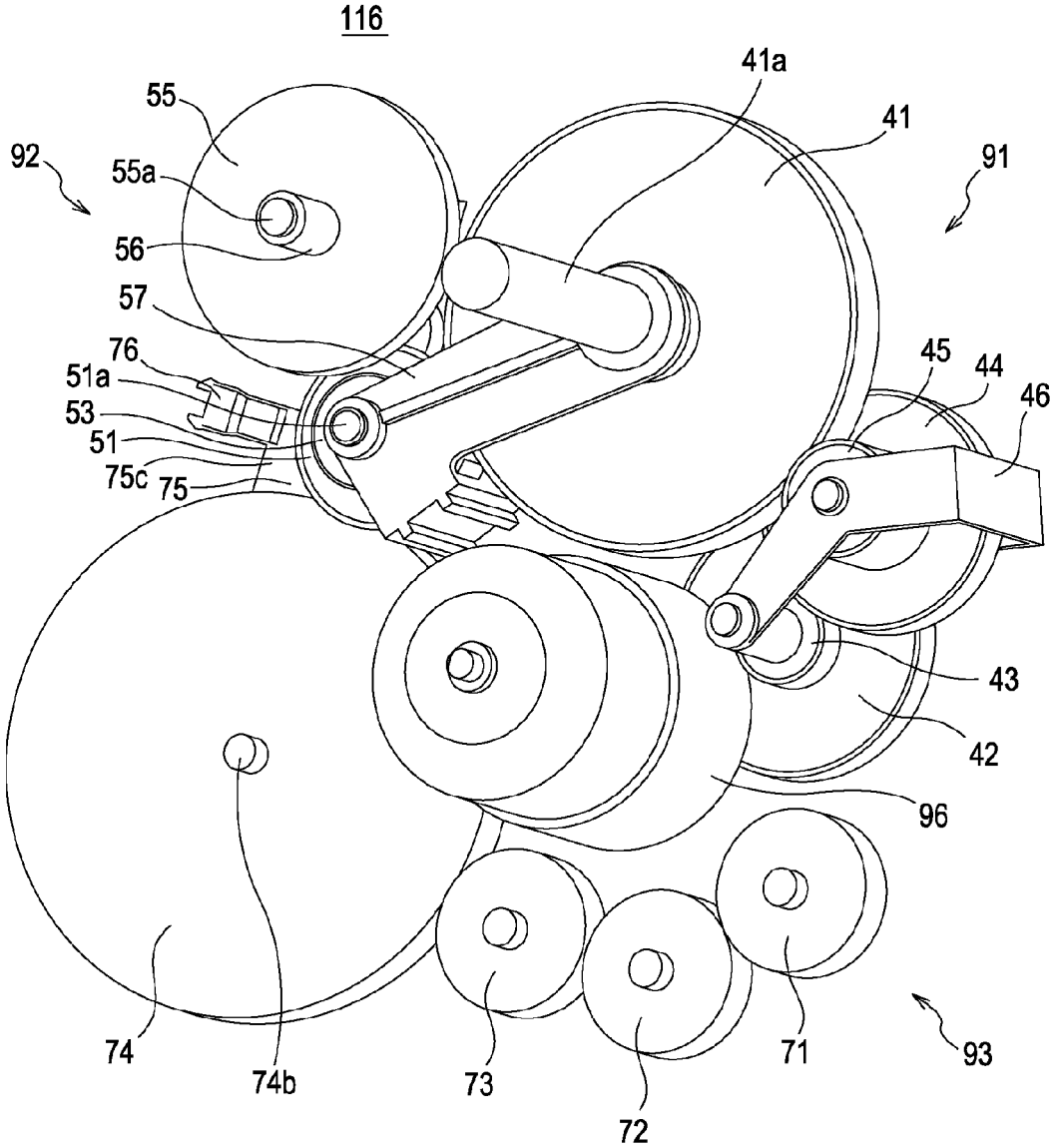
FIG. 12 is a perspective view of the tension adjustment mechanism of the rolled medium holding device shown in FIG. 3 according to a second embodiment, viewed from a bottom side.

FIGS. 11 and 12 are perspective views of the tension adjustment mechanism 116 according to a second embodiment as viewed from front and bottom sides. The tension adjustment mechanism 116 includes a planetary gear mechanism (first gear mechanism) 91, a hybrid gear mechanism (second gear mechanism) 92, a gear shifting mechanism 93, first and second torque limiters 94 and 95 generating first and second torques that are different from each other, and one servo motor (driving means) 96. The tension adjustment mechanism 116 is disposed in the fixing flange receiver 113 shown in FIG. 3.

The planetary gear mechanism 91 includes a roll gear 41 fitted to a shaft 41*a* connected to the roll shaft 119 that is fitted to the flange 117 shown in FIG. 3, a first sun gear 42 interlocked with a motor gear 96*b* that is fitted to a motor shaft 96*a* of the servo motor 96, and a second sun gear 43 that is disposed concentrically with the first sun gear 42. In addition, the planetary gear mechanism 91 includes a first planetary gear 44 interlocked with the second sun gear 43, a second planetary gear 45 that is disposed concentrically with the first planetary gear 44 and can be interlocked with the roll gear 41, and a link 46 connecting a shaft 42*a* of the first and second sun gears 42 and 43 and a shaft 44*a* of the first and second planetary gears 44 and 45.

The hybrid gear mechanism 92 includes a torque transmission gear 51 interlocked with the roll gear 41, a first torque transmission gear 52 and a second torque transmission gear 53 that are concentrically disposed on both sides of the torque transmission gear 51, a first torque limiter gear 54 that is interlocked with the first torque transmission gear 52 and is disposed concentrically with the first torque limiter 94. In addition, the hybrid gear mechanism 92 includes a second torque limiter gear 55 that is interlocked with the second torque transmission gear 53 and disposed concentrically with the second torque limiter 95, a compression spring 56 that presses the second torque limiter gear 55, the second torque limiter 95, and the shaft 55*a* thereof to a cam bar 75 side, and a link 57 that connects the shaft 41*a* of the roll gear 41, a shaft of the torque transmission gear 51, the first torque transmission gear 52, and the shaft 51*a* of the second torque transmission gear 53.

The gear shifting mechanism 93 includes a first shift gear 71 that can be fitted to the first planetary gear 44, a second shift gear 72 that is interlocked with the first shift gear 71, a third shift gear 73 that is interlocked with the second shift gear 72, a circular cam groove 74*a*, and a cam gear 74 that is interlocked with the third shift gear 73. In addition, the gear shifting mechanism 93 includes a cam 75*a* fitted to the cam groove 74*a* of the cam gear 74, a cam bar 75 in which a linear cam groove 75*b* having two-level notches fitted to the shaft 55*a* of the second torque limiter gear 95 and the shaft 55*a* of the second torque limiter 95 is provided, and a photo coupler 76 that is disposed near the cam bar 75.

The cam groove 74*a* of the cam gear 74 is formed in a side of the cam gear 74 as a shape of a circle that is eccentric with respect to the shaft 74*b* of the cam gear 74. The cam bar 75 is formed in the shape of a rod, and the cam 75*a* is formed to protrude from a side of one end of the cam bar 75 and slides for moving in a circumference along the cam groove 74*a* of the cam gear 74. The cam groove 75*b* is formed in the other end of the cam bar 75, and the second torque limiter gear 55 and allows the shaft 55*a* of the second torque limiter 95 to slide straight between the two-level notches (hereinafter, referred to as a first level 75*ba* and a second level 75*bb*) for moving. The photo coupler 76 detects a shade 75*c* that is provided in the center of the side of the cam bar 75 for sending a signal indicating whether the second torque limiter gear 55 and the shaft 55*a* of the second torque limiter 95 are positioned in the first level 75*ba* or the second level 75*bb*. In the above-described configuration, operations will now be described with reference to the accompanying drawings.

Figure 13:
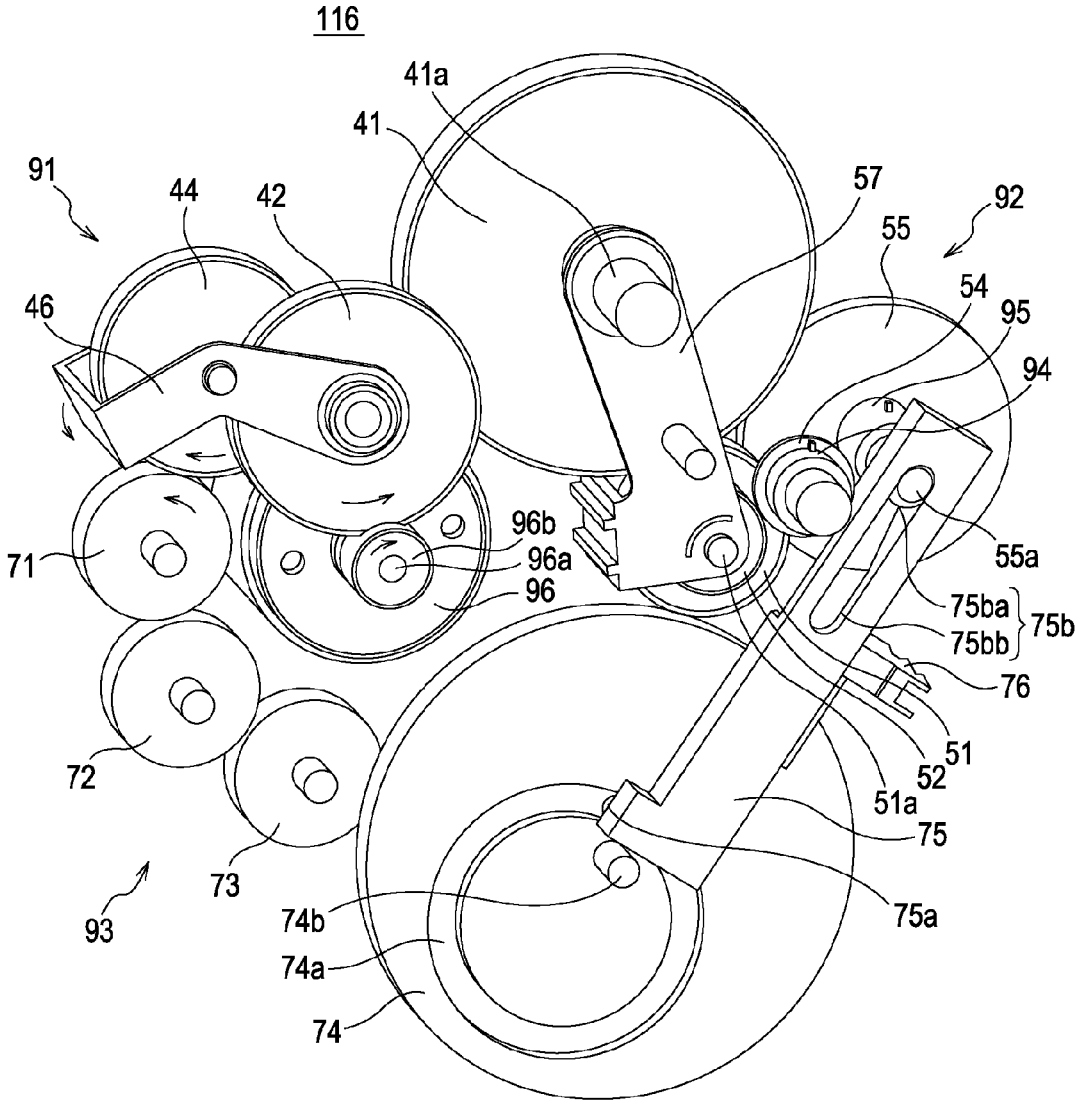
FIG. 13 is a perspective view showing a status at a time when back tension of roll paper of the tension adjustment mechanism shown in FIG. 11 is shifted.

FIG. 11 is a perspective view showing a status at a time when the transport of the roll paper is waited for or the roll paper is rewound. FIG. 13 is a perspective view showing a status at a time when the first back tension or the second back tension is to be applied in transport of the roll paper or when it is shifted to the first torque limiter 94 or the second torque limiter 95 (hereinafter, referred to a time when the back tension of the roll paper is shifted) in start of recording on the roll paper.

When the roll paper is rewound, as shown in FIG. 11, the servo motor 96 is driven to rotate in a left direction shown in the figure for rotating the first and second sun gears 42 and 43 in a right direction shown in the figure and interlocks the second planetary gear 45 with the roll gear 41 by rotating the first and second planetary gears 44 and 45 in the left direction shown in the figure and turning the link 46 in the right direction shown in the figure. By the operations above, the roll shaft 119 connected to the shaft 41*a* of the roll gear 41 rotates in the right direction shown in the figure, and accordingly, the roll paper fitted to the roll shaft 119 through the flange 117 is rewound by rotating in the right direction shown in the figure.

When the back tension of the roll paper is shifted, as shown in FIG. 13, the servo motor 96 is driven to rotate in the right direction shown in the figure for rotating the first and second sun gears 42 and 43 in the left direction shown in the figure and interlocks the first planetary gear 44 with the first shift gear 71 by rotating the first and second planetary gears 44 and 45 in the right direction shown in the figure and turning the link 46 in the left direction shown in the figure. Here, in cases of shifting the first back tension of the roll paper and shifting the second back tension of the roll paper will now be described additionally with reference to drawings.

Figure 14:
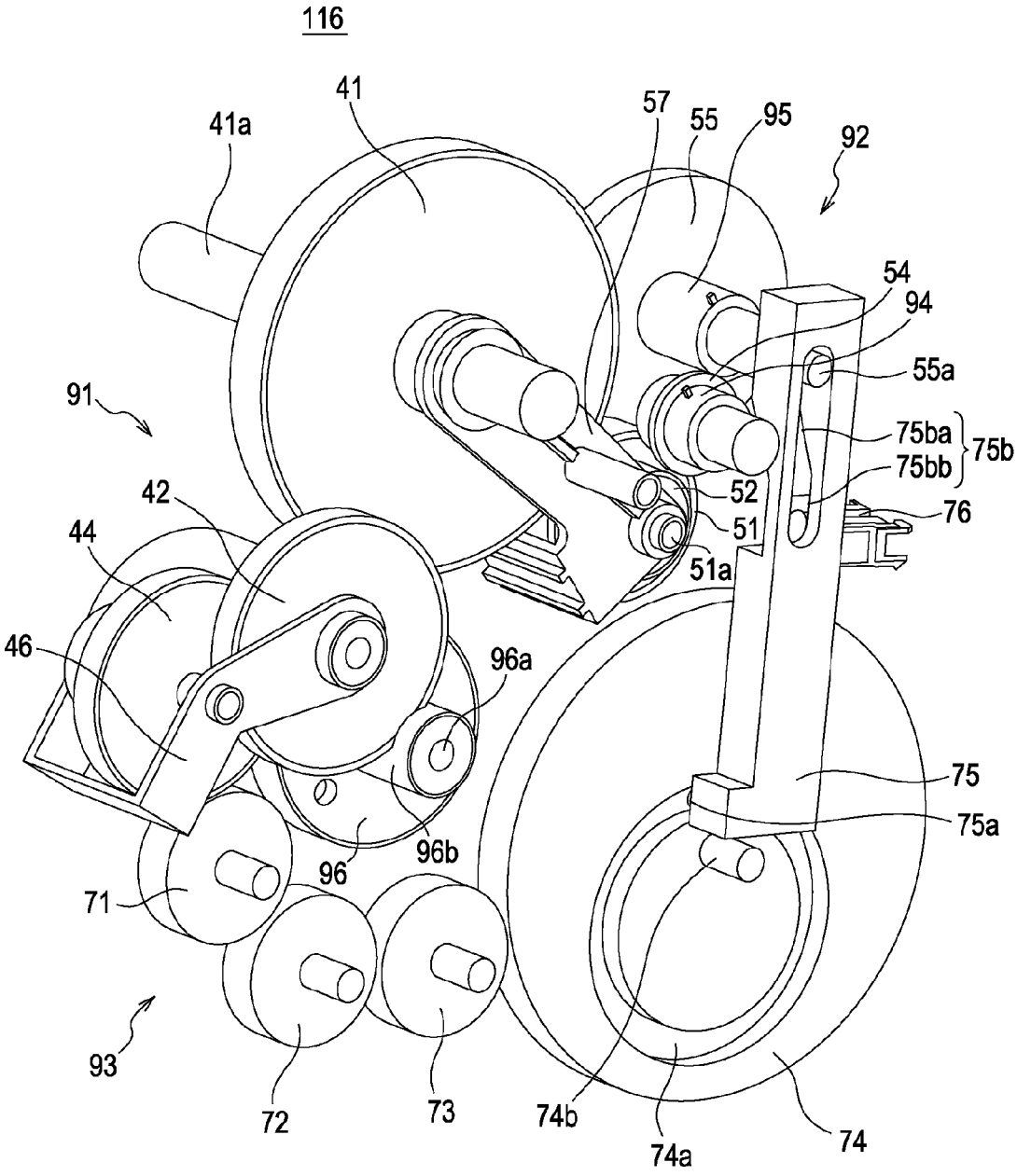
FIG. 14 is a perspective view of the tension adjustment mechanism shown in FIG. 11 viewed from a front side at a time when the first back tension is shifted.
Figure 15:
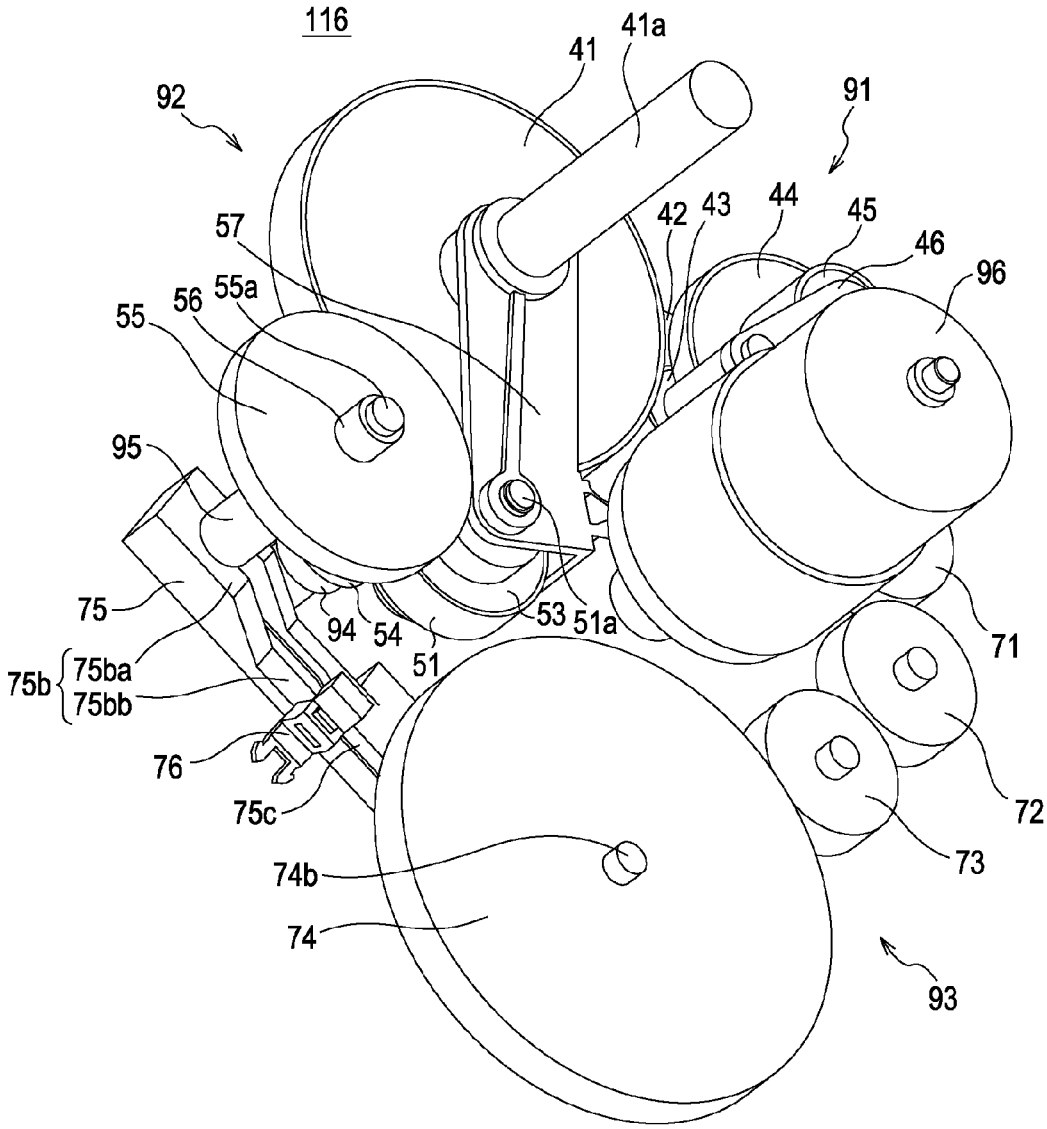
FIG. 15 is a perspective view of the tension adjustment mechanism shown in FIG. 11 viewed from a bottom side at a time when the first back tension of the roll paper is shifted.
Figure 16:
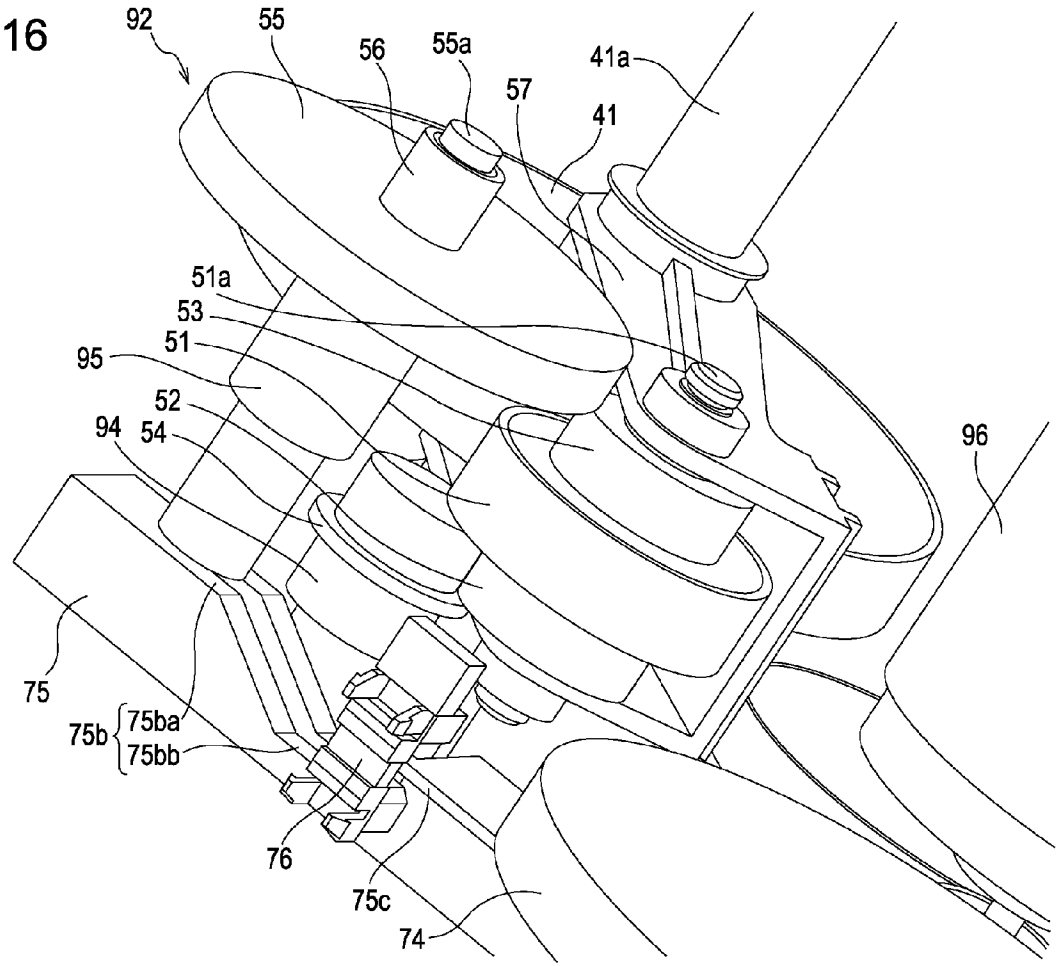
FIG. 16 is an enlarged perspective view of FIG. 15.

FIGS. 14 and 15 are perspective views of a tension adjustment mechanism 116 viewed from a front side and a bottom side at a time when the first back tension of the roll paper is shifted. FIG. 16 is an enlarged perspective view of FIG. 15. When the first back tension of the roll paper is shifted, as shown in FIG. 14, the servo motor 96 is driven to rotate in the right direction shown in the figure for rotating the first and second sun gears 42 and 43 in the left direction shown in the figure and interlocks the first planetary gear 44 with the first shift gear 71 by rotating the first and second planetary gears 44 and 45 in the right direction shown in the figure and turning the link 46 in the left direction shown in the figure. The servo motor 96 rotates the cam gear 74 in the right direction shown in the figure through the second shift gear 72 and the third shift gear 73 and slides the cam 75*a* of the cam bar 75 for moving along the cam groove 74*a* of the cam gear 74 for determining a position of the cam grove 74*a* of the cam gear 74 at a position closest to the shaft 74*b* of the cam gear 74.

By the operations above, as shown in FIGS. 15 and 16, the second torque limiter gear 55 and the shaft 55*a* of the second torque limiter 95 slide for moving along the cam groove 75*b* of the cam bar 75 to be positioned at the first level 75*ba*, and accordingly, the second torque limiter gear 55 is released from being interlocked with the second torque transmission gear 53 and the first torque limiter gear 54 is interlocked with the first torque transmission gear 52. Thus, since torque of the first torque limiter 94 is transferred from the first torque limited gear 54 through the first torque transmission gear 52 and is transferred from the torque transmission gear 51 to the roll gear 41, the first back tension is applied to the roll paper.

Figure 17:
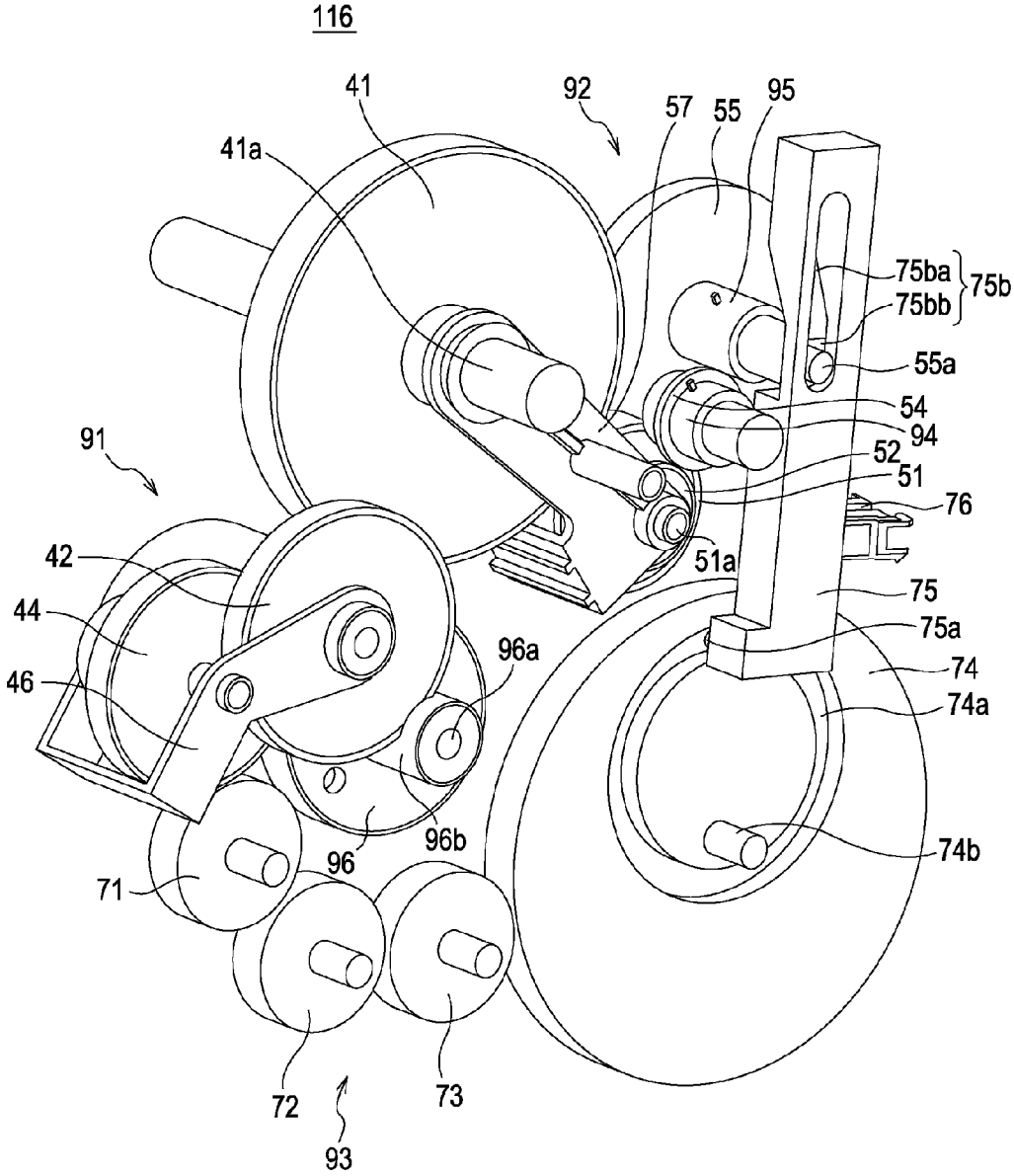
FIG. 17 is a perspective view of the tension adjustment mechanism shown in FIG. 11 viewed from a front side at a time when second back tension of the roll paper is shifted.
Figure 18:
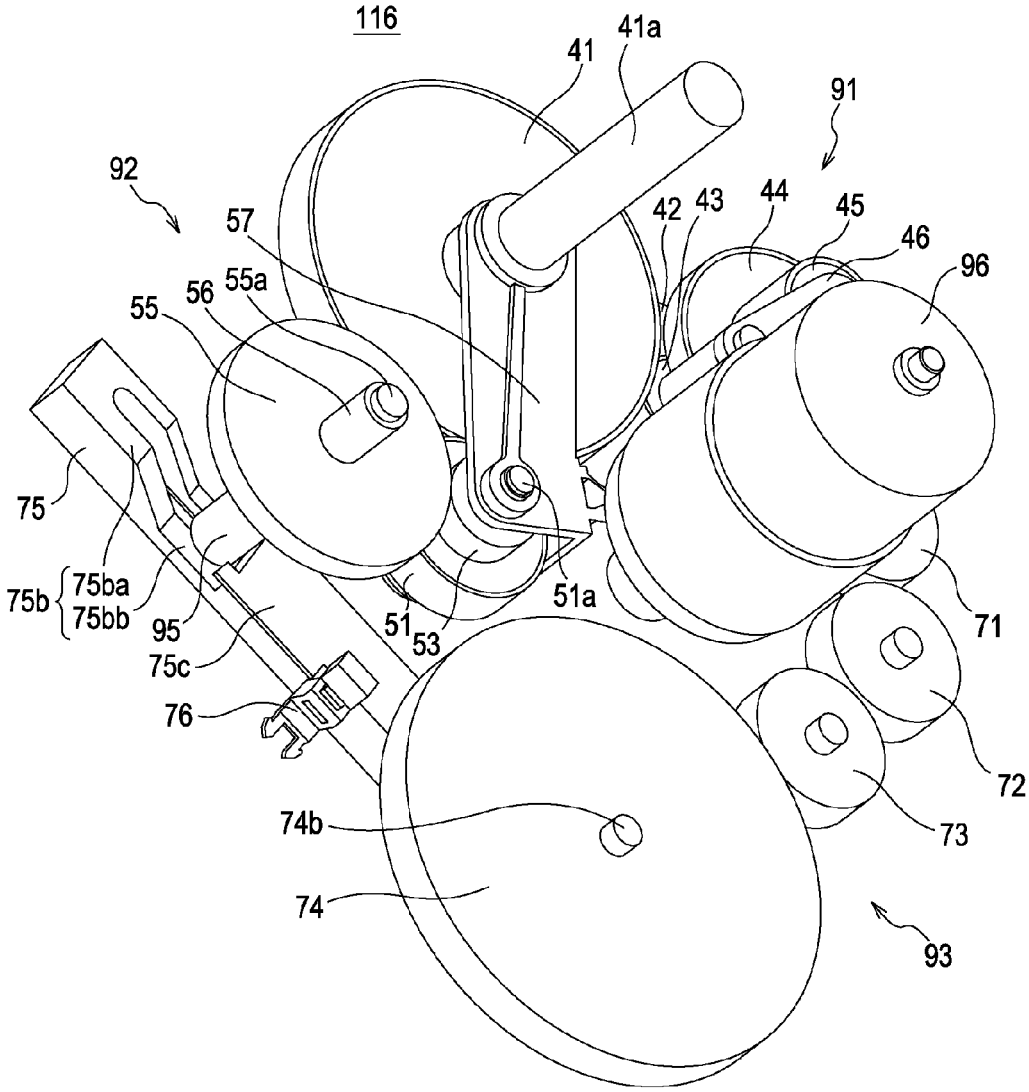
FIG. 18 is a perspective view of the tension adjustment mechanism shown in FIG. 11 viewed from a bottom side at a time when the second back tension of the roll paper is shifted.
Figure 19:
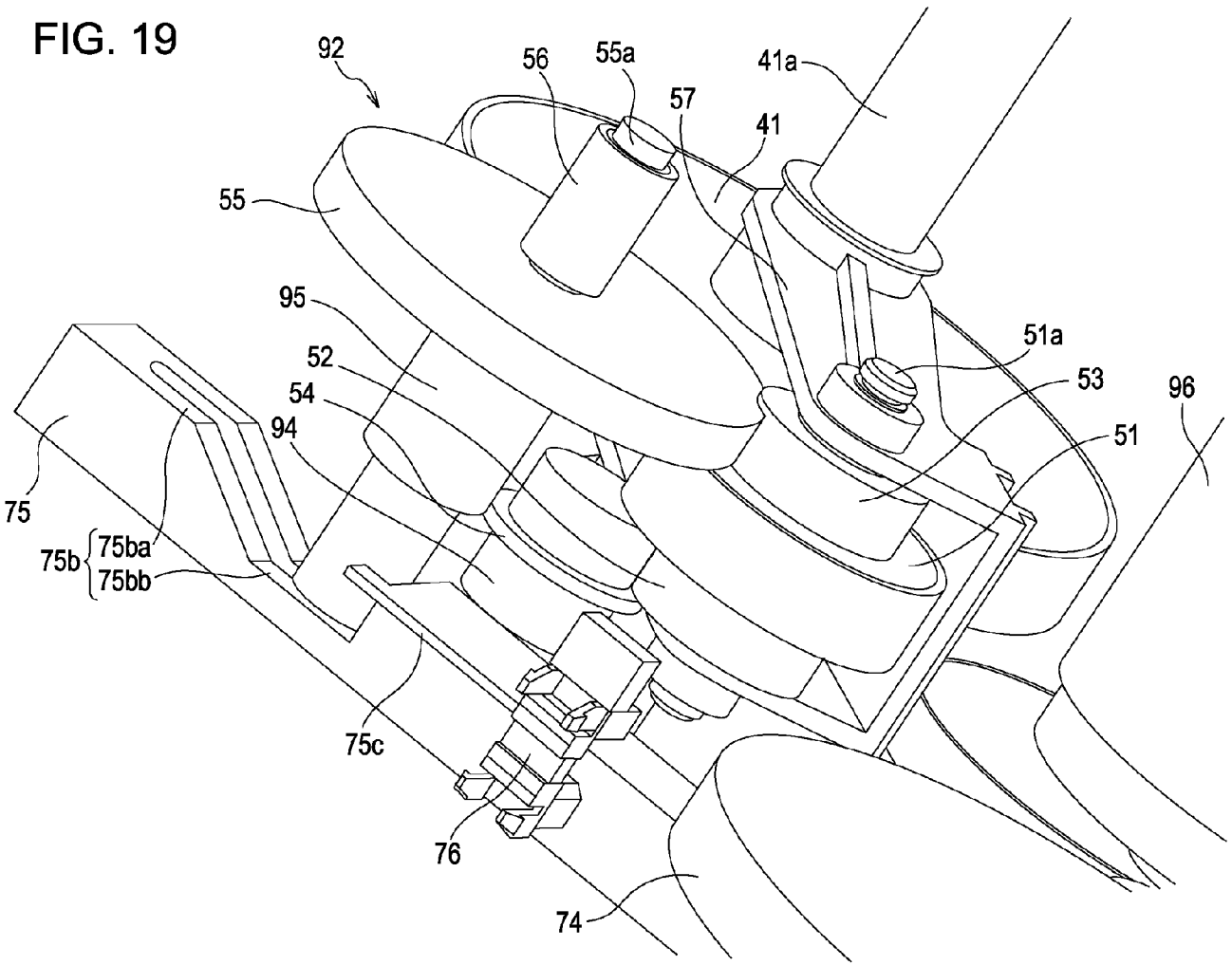
FIG. 19 is an enlarged perspective view of FIG. 18.

FIGS. 17 and 18 are perspective views of the tension adjustment mechanism 116 viewed from a front side and a bottom side at a time when the second back tension of the roll paper is shifted. FIG. 19 is an enlarged perspective view of FIG. 18. When the second back tension of the roll paper is shifted, as shown in FIG. 17, the servo motor 96 is driven to rotate in the right direction shown in the figure for rotating the first and second sun gears 42 and 43 in the left direction shown in the figure and interlocks the first planetary gear 44 with the first shift gear 71 by rotating the first and second planetary gears 44 and 45 in the right direction shown in the figure and turning the link 46 in the left direction shown in the figure. The servo motor 96 rotates the cam gear 74 in the right direction shown in the figure through the second shift gear 72 and the third shift gear 73 and slides the cam 75*a* of the cam bar 75 for moving along the cam groove 74*a* of the cam gear 74 for determining a position of the cam grove 74*a* of the cam gear 74 at a position farmost from the shaft 74*b* of the cam gear 74.

By the operations above, as shown in FIGS. 17 and 18, the second torque limiter gear 55 and the shaft 55*a* of the second torque limiter 95 slide for moving along the cam groove 75*b* of the cam bar 75 to be positioned at the second level 75*bb*, and accordingly, the torque limiter gear 54 is released from being interlocked with the first torque transmission means 52 and the second torque limiter gear 55 is interlocked with the second torque transmission gear 53. Thus, since torque of the second torque limiter 95 is transferred from the second torque limited gear 55 through the second torque transmission gear 53 and is transferred from the torque transmission gear 51 to the roll gear 41, the second back tension is applied to the roll paper.

Operations of the tension adjustment mechanism 116 according to the second embodiment having the above-described configuration until start of recording will now be described. When roll paper is set in an ink jet printer 100 and a power button of an operation panel 160 is turned on, information on the set roll paper, for example, a type of paper, paper thickness, a paper size, and the like is sent to a control unit controlling the driving of the tension adjustment mechanism 116. The information on the roll paper, for example, is sent from a printer driver that is stored in advance in a recording section of the control unit or is sent by user's input through an operation of a key on an operation panel 160.

The control unit controls driving of the tension adjustment mechanism 116 on the basis of the information on the roll paper, whereby operating the shift of the first back tension or the second back tension described above. At this moment, the control unit receives a detection signal from the photo coupler 76 and determines whether the shift of the first back tension or the second back tension is performed assuredly. Subsequently, the control unit operates the above-described rewinding of the roll paper right before start of recording and applies temporary back tension to the roll paper, whereby removing loosening of the roll paper right after feeding of the roll paper. By the operations described above, precision of a recording image can be improved by suppressing generation of wrinkles during transport of the roll paper.

As described above, in the roll paper holder 111 according to the second embodiment, since torque transferred by the first and second torque limiters 94 and 95 can be changed by the gear shifting mechanism 93, back tension in correspondence with a used roll paper can be applied easily in a simple manner. In addition, since the hybrid gear mechanism 92 includes the first and second torque transmission gears 52 and 53, a transmission ratio and a value of torque transferred by the first and second torque limiters 94 and 95 can be shifted easily in a simple manner. In addition, since the planetary gear mechanism 91 includes the first planetary gear 44 interlocked with the second sun gear 43, torque transmission of the first and second torque limiters 94 and 95 can be blocked easily in a simple manner. The first and the second torque limiters 94 and 95 may have a general structure such as a helical torsion spring structure.

In addition, since the roll paper holder 111 includes the servo motor 96 for operating the planetary gear mechanism 91, an error in the connection shifting between the planetary gear mechanism 91 and the first and second torque limiters 94 and 95 of the hybrid gear mechanism 92 does not occur, whereby precise back tension can be applied to the roll paper. In addition, since the servo motor 96 operates the planetary gear mechanism 91 on the basis of the information on the roll paper, an appropriate back tension for the roll paper can be applied assuredly. In addition, since rewinding of the roll paper along with back tension shifting for the roll paper can be operated by only providing one servo motor 96, a manufacturing cost or a product cost of the roll paper holder 11 can be reduced.

In the above-described second embodiment, although the hybrid gear mechanism 92 includes the first and second torque limiters 94 and 95 and two successive first and second torque transmission gears 52 and 53, however, the present invention is not limited thereto and the hybrid gear mechanism 92 may include arbitrary number of torque limiters and arbitrary number of successive torque transmission gears.

In addition, the roll paper holder 111 according to the embodiment may be any type of a recording apparatus using roll paper such as a facsimile apparatus and a copy machine.

The invention claimed is:

1. A rolled medium holding device comprising:

a first gear mechanism that is connected to a roll shaft holding the rolled medium and sends out/rewinds the rolled medium;

a second gear mechanism that is connected to a torque limiter and includes a plurality of torque transfer gears that are connected with the first gear mechanism and are inserted into a shaft and transfer the first and second torque different with each other; and a gear switching mechanism that shifts connection between the plurality of torque transfer gears and the first gear mechanism to apply different back tensions to the roll shaft;

wherein the gear switching mechanism comprises a cam portion inserted into the shaft in a rotatable manner and which has a second cam formed integrally in an inner circumference portion to move the plurality of torque transfer gears in the shaft direction, and wherein the gear switching mechanism changes the back tension by rotating the cam portion.

2. The rolled medium holding device according to claim 1, the second gear mechanism comprises a hybrid gear which has the plurality of torque transfer gears.

3. The rolled medium holding device according to claim 1, wherein the first gear mechanism comprises a planetary gear which connects the plurality of torque transfer gears.

4. The rolled medium holding device according to claim 1, further comprising driving means that operates the first gear mechanism.

5. The rolled medium holding device according to claim 4, wherein the driving means additionally operates the second gear mechanism.

6. The rolled medium holding device according to claim 5, wherein the driving means operates the second gear mechanism on the basis of information on the rolled medium.

7. The rolled medium holding device according to claim 4, wherein the driving means operates the first gear mechanism on the basis of information on the rolled medium.

8. The rolled medium holding device according to claim 4, wherein the driving means temporarily applies back tension to the rolled medium by rewinding the rolled medium right before start of a recording operation.

9. The rolled medium holding device according to claim 1, wherein the rolled medium holding device is part of a recording apparatus, the recording apparatus comprising:

a recording head that performs recording on the rolled medium while transporting the rolled medium, and the rolled medium holding device according to claim 1.

10. The rolled medium holding device according to claim 1, wherein the cam portion has a first cam formed integrally in an outer circumference portion to release the connection between the plurality of torque transfer gears and the first gear mechanism by making contact with a boss of the second mechanism, and wherein the gear switching mechanism releases the back tension by rotating the cam portion during forward rotation of the roll shaft.

11. A rolled medium holding device comprising:

a back tension mechanism that applies back tension by forward rotation of a roll shaft holding a rolled medium and releases the applied back tension by backward rotation of the roll shaft, wherein the back tension mechanism comprises a spring clutch that is inserted into the roll shaft and generates slipping torque/tightening torque on the roll shaft by expansion/contraction thereof in a diameter direction, and wherein torque is transferred in a drawing-out direction of the rolled medium in accordance with the slipping torque of the spring clutch and transfer of the torque in a rewinding direction is blocked by the tightening torque, wherein the back tension mechanism further comprises:

a first gear mechanism that is connected to the roll shaft;

a second gear mechanism that is connected to the spring clutch; and a gear shifting mechanism that shifts connection between the first gear mechanism and the second gear mechanism, and wherein the gear shifting mechanism comprises a cam portion inserted in a rotatable manner and which has a first cam formed integrally in an outer circumference portion to release the connection between the first gear mechanism and the second gear mechanism by making contact with a boss of the second mechanism, and wherein the gear shifting mechanism releases the back tension by rotating the cam portion during forward rotation of the roll shaft.

12. The rolled medium holding device according to claim 11, wherein the gear shifting mechanism includes a plurality of torque transfer gears that are connected with the first gear mechanism and are inserted into a shaft and transfer the first and second torque different with each other; and wherein the cam portion has a second cam formed integrally in an inner circumference portion to move the plurality of torque transfer gears in the shaft direction, and wherein the gear shifting mechanism changes the back tension by rotating the cam portion.

13. The rolled medium holding device according to claim 12, wherein one end of the spring clutch is pinched by the second gear mechanism and the other end of the spring clutch is pinched by a bearing that is fitted to a shaft of the second gear mechanism.

14. The rolled medium holding device according to claim 12, wherein the second gear mechanism comprises a hybrid gear which has a plurality of torque transfer gears.

15. The rolled medium holding device according to claim 12, wherein the first gear mechanism comprises a planetary gear which connects the plurality of torque transfer gears.

16. The rolled medium holding device according to claim 11, wherein the rolled medium holding device is part of a recording apparatus, the recording apparatus comprising:

a recording head that records on the rolled medium while transporting the rolled medium, and the rolled medium holding device according to claim 11.

* * * * *